US008128187B2

(12) United States Patent
Konno

(10) Patent No.: US 8,128,187 B2
(45) Date of Patent: Mar. 6, 2012

(54) RECORDING HEAD, DROPLET DISCHARGE DEVICE AND DROPLET DISCHARGE METHOD

(75) Inventor: Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 498 days.

(21) Appl. No.: 12/412,066

(22) Filed: Mar. 26, 2009

(65) Prior Publication Data

US 2009/0244138 A1 Oct. 1, 2009

(30) Foreign Application Priority Data

Mar. 31, 2008 (JP) ..... 2008-091430
Mar. 31, 2008 (JP) ..... 2008-091431
Mar. 31, 2008 (JP) ..... 2008-091432

(51) Int. Cl.
*B41J 29/393* (2006.01)
*B41J 29/38* (2006.01)
*B41J 2/15* (2006.01)

(52) U.S. Cl. ..... 347/19; 347/12; 347/40

(58) Field of Classification Search ..... 347/12, 347/14, 19, 40
See application file for complete search history.

(56) References Cited

U.S. PATENT DOCUMENTS 5,771,050 A * 6/1998 Gielen ..... 347/19
2002/0024555 A1 2/2002 Fujioka et al.
2004/0041881 A1 3/2004 Okuda et al.
2005/0200684 A1* 9/2005 Sakurada et al. ..... 347/105
2008/0158278 A1* 7/2008 Inoue ..... 347/12

FOREIGN PATENT DOCUMENTS

JP 2002-103579 A 4/2002
JP 2004-90504 A 3/2004
JP 2007-29786 A 2/2007

* cited by examiner

*Primary Examiner* — Matthew Luu
*Assistant Examiner* — Jannelle M Lebron
(74) *Attorney, Agent, or Firm* — Birch, Stewart, Kolasch & Birch, LLP

(57) ABSTRACT

A recording head includes plural nozzle groups and a second nozzle. Each of the nozzle groups includes plural nozzles that respectively form dots, which make up an image, on a recording medium by discharging droplets. The nozzles are arranged in a straight line that is inclined with respect to a main scan direction at a predetermined angle. The plural nozzle groups are arranged in a sub scan direction such that intervals in the sub scan direction between nozzles adjacent in the sub scan direction are substantially identical and positions in the sub scan direction of nozzles belonging to the respective nozzle groups are substantially aligned. The second nozzle is disposed at a substantially central portion in the main scan direction between adjacent nozzles of nozzle groups adjacent in the sub scan direction so as not to overlap with any other nozzle in the main scan direction.

9 Claims, 21 Drawing Sheets

RECORDING HEAD, DROPLET DISCHARGE DEVICE AND DROPLET DISCHARGE METHOD

CROSS-REFERENCE TO RELATED APPLICATION

This application claims priority under 35 USC 119 from Japanese Patent Application Nos. 2008-091430, 2008-091431 and 2008-091432, the disclosures of which are incorporated by reference herein.

BACKGROUND OF THE INVENTION

1. Field of the Invention

The present invention relates to a recording head having a nozzles, a droplet discharge device for discharging droplets from a nozzle while moving the recording head back and forth, and a droplet discharge method using the recording head.

2. Description of the Related Art

Recently, a droplet discharge device that forms an image by discharging droplets while moving, back and forth in a main scan direction, a recording head that forms dots that compose an image on a recording medium, and by relatively moving at least one of the recording head and the recording medium in a sub scan direction orthogonal to the main scan direction, has become common.

Further, for the recording head, a recording head in which plural nozzles are arranged in a two-dimensional fashion (matrix type recording head) in order to densely arrange a number of nozzles within a limited nozzle surface area is well known, and in image formation using a matrix type recording head, because droplet discharge by densely arranged nozzles is possible, a high-quality image may be obtained at high-speed. For example, in a case of image formation using a matrix recording head with numerous high-density nozzles as shown in FIG. 17, high-density and multiple droplet discharge in the sub scan direction is possible by means of a single main scan, so that a high quality image may be obtained at high speed.

However, in a droplet discharge device using a matrix type recording head, there has been a problem whereby a formed image is susceptible to concentration unevenness in the sub scan direction.

In order to solve the problem, Japanese Patent Application Laid-Open (JP-A) No. 2004-90504 discloses a technique to decrease the visibility of concentration unevenness by increasing the spatial frequency of the concentration unevenness in the sub scan direction by mixing dots having a large diameter and dots having a small diameter and by forming the dots at constant intervals.

Further, JP-A No. 2007-29786 discloses a technique in which the recording head has a nozzle group composed of a first nozzle line at an angle $\phi$ with respect to the main scan direction and a second nozzle line at an angle $-\phi$ with respect to the main scan line and intersecting to the first nozzle line, and the nozzle lines are arranged in an X-shape such that adjacent nozzles belong to different nozzle lines when the nozzle group is projected in the main scan direction so as to align the projected positions of all the nozzles in a straight line, thereby decreasing the visibility of concentration unevenness occurring in the formed image.

JP-A No. 2002-103579 discloses a technique to prevent a striped pattern from occurring in the sub scan direction by recording the image by making two adjacent rasters formed on the recording medium by the same nozzle serve as one unit in the forward movement and backward movement in the main scan direction in a recording head having plural nozzles arranged in a zig-zag manner along the sub scan direction.

However, in the technique disclosed in JP-A No. 2004-90504, in the recording head in which plural nozzle groups, which have plural nozzles arranged in a straight line that is inclined with respect to a moving direction at a predetermined angle, are arranged in the sub scan direction such that the intervals in the sub scan direction between nozzles adjacent in the sub scan direction are substantially identical and the positions in the sub scan direction of the nozzles belonging to the respective nozzle groups are substantially aligned, there is a problem that the concentration unevenness in the sub scan direction cannot be reduced, the concentration unevenness occurred due to difference in density of the dots that is formed by the adjacent nozzles between nozzle groups adjacent in the sub scan direction and the dots formed by the nozzles belonging to the respective nozzle groups by the recording head inclined by inertia force in accordance with the motion in the main scan direction. Also, in the technique disclosed in JP-A No. 2007-29786, there has been a problem that the nozzle arrangement is complicated and the design of the flow path for feeding the nozzle with the ink liquid is restricted. In addition, in the technique disclosed in JP-A No. 2002-103579, there has been a problem that the technique sometimes may not be applied to the recording head with high-density nozzle arrangement.

Also, the image formation by using the matrix type recording head has a problem that the concentration unevenness in the sub scan direction easily occurs due to the displacement of the head posture. For example, as shown in FIG. 17, although the intervals between adjacent dots in the sub scan direction are constant when the matrix type recording head is correctly attached at a predetermined angle with respect to the main scan direction, in a case in which there is a slight error in angle in the head posture, the interval a between dots adjacent in the sub scan direction in the nozzle arrangement and the interval b between dots adjacent in the sub scan direction at a folded portion of the nozzle arrangement differs to each other, and a high concentration portion and a low concentration portion occur at an interval of folded pitch P of the nozzle line, so that the concentration unevenness in the sub scan direction is visually recognized.

In the above-described documents, the method to effectively reduce the concentration unevenness occurred at the folded portion of the nozzle line is not disclosed.

SUMMARY OF THE INVENTION

The present invention has been made in view of the above circumstances and provides a recording head, a droplet discharge device and a droplet discharge method.

A first aspect of the present invention provides a recording head includes plural nozzle groups and a second nozzle. Each of the nozzle groups includes plural nozzles that respectively form dots, which make up an image, on a recording medium by discharging droplets. The nozzles are arranged in a straight line that is inclined with respect to a main scan direction at a predetermined angle. The plural nozzle groups are arranged in a sub scan direction such that intervals in the sub scan direction between nozzles adjacent in the sub scan direction are substantially identical and positions in the sub scan direction of nozzles belonging to the respective nozzle groups are substantially aligned. The second nozzle is disposed at a substantially central portion in the main scan direction between adjacent nozzles of nozzle groups adjacent in the sub scan direction so as not to overlap with any other nozzle in the main scan direction.

A second aspect of the present invention provides a droplet discharge device including the above-mentioned recording head, a moving unit, a conveyance unit, a determination unit, and a control unit. The moving unit moves the recording head back and forth in the main scan direction. The conveyance unit relatively conveys at least one of the recording head and the recording medium in the sub scan direction. The determination unit determines a correction amount of droplets discharged from the second nozzle. The control unit controls droplet discharge by the recording head while correcting the amount of the droplets discharged from the second nozzle based on the correction amount determined by the determination unit, when forming an image on the recording medium.

A third aspect of the present invention provides a droplet discharge method in a droplet discharge device that includes the above-mentioned recording head, a moving unit that moves the recording head back and forth in the main scan direction, and a conveyance unit that relatively conveys at least one of the recording head and the recording medium in the sub scan direction. The method includes determining a correction amount of a droplet discharged from the second nozzle so as to reduce concentration unevenness in the sub scan direction of the image formed on the recording medium, and controlling droplet discharge by the recording head while correcting the amount of the droplets discharged from the second nozzle based on the correction amount, when forming the image on the recording medium.

A forth aspect of the present invention provides a droplet discharge device includes a recording head, a moving unit, a conveyance unit, and a control unit. The recording head includes a plurality of nozzle groups. Each of the nozzle groups includes plural nozzles that respectively form dots, which make up an image, on a recording medium by discharging droplets and being arranged in a straight line inclined with respect to a main scan direction at a predetermined angle. The plural nozzle groups are arranged in a sub scan direction such that intervals in the sub scan direction between nozzles adjacent in the sub scan direction are substantially identical and positions in the sub scan direction of nozzles belonging to the respective nozzle groups are substantially aligned. The moving unit moves the recording head back and forth in the main scan direction. The conveyance unit relatively conveys at least one of the recording head and the recording medium in the sub scan direction. A determination unit determines a correction amount of droplets discharged from at least one of adjacent nozzles of nozzle groups adjacent in the sub scan direction. The control unit controls droplet discharge by the recording head while correcting the amount of the droplets discharged from the at least one of the adjacent nozzles of the nozzle groups adjacent in the sub scan direction, based on the correction amount determined by the determination unit when forming the image on the recording medium.

A fifth aspect of the present invention provides a droplet discharge method in a droplet discharge device that includes a recording head that includes plural nozzle groups, each of the nozzle groups including plural nozzles that respectively form dots, which make up an image, on a recording medium by discharging droplets and being arranged in a straight line inclined with respect to a main scan direction at a predetermined angle, the plural nozzle groups being arranged in a sub scan direction such that intervals in the sub scan direction between nozzles adjacent in the sub scan direction are substantially identical and positions in the sub scan direction of nozzles belonging to the respective nozzle groups are substantially aligned; a moving unit that moves the recording head back and forth in the main scan direction; and a conveyance unit that relatively conveys at least one of the recording head and the recording medium in the sub scan direction. The method includes determining a correction amount of droplets discharged from at least one of adjacent nozzles of the nozzle groups adjacent in the sub scan direction so as to reduce concentration unevenness in the sub scan direction of the image formed on the recording medium, and controlling droplet discharge by the recording head while correcting the amount of the droplets discharged from the at least one of the adjacent nozzles of the nozzle groups adjacent in the sub scan direction based on the correction amount, when forming the image on the recording medium.

A sixth aspect of the present invention provides a droplet discharge device including a recording head, a moving unit, and a conveyance unit. The recording head includes plural nozzle groups, each of the nozzle groups including plural nozzles that respectively form dots, which make up an image, on a recording medium by discharging droplets and being arranged in a straight line inclined with respect to a main scan direction at a predetermined angle. The plural nozzle groups are arranged in a sub scan direction such that intervals in the sub scan direction between nozzles adjacent in the sub scan direction are substantially identical and positions in the sub scan direction of nozzles belonging to the respective nozzle groups are substantially identical. The moving unit moves the recording head back and forth in the main scan direction while inclining the recording head in one direction with respect to an axis orthogonal to the main scan direction during forward movement and in an opposing direction with respect to the axis orthogonal to the main scan direction during the backward movement. The conveyance unit relatively conveys at least one of the recording head and the recording medium in the sub scan direction during the forward movement and the backward movement of the recording head by the moving unit, by a distance obtained by multiplying a predetermined integer smaller than the number of the nozzle groups by a width in the sub scan direction of a dot forming area of one of the nozzle groups.

A seventh aspect of the present invention provides a image forming method including moving a recording head back and forth in a main scan direction while inclining the recording head in one direction with respect to an axis orthogonal to the main scan direction during forward movement and in an opposing direction with respect to the axis orthogonal to the main scan direction during backward movement, the recording head including plural nozzle groups each including plural nozzles that respectively form dots, which make up an image, on a recording medium by discharging droplets and being arranged in a straight line inclined with respect to the main scan direction at a predetermined angle, the plural nozzle groups being arranged in a sub scan direction such that intervals in the sub scan direction between nozzles adjacent in the sub scan direction are substantially identical and positions in the sub scan direction of nozzles belonging to each of the nozzle groups are substantially identical. The method further includes relatively conveying at least one of the recording head and the recording medium in the sub scan direction by a distance obtained by multiplying a predetermined integer smaller than the number of the nozzle groups by a width in the sub scan direction of a dot forming area of one of the nozzle groups during the forward movement and the backward movement of the recording head.

The term "substantially identical" or "substantially central" used herein is intended to mean to be identical or central in design while allowing shift due to manufacturing error.

DETAILED DESCRIPTION OF THE INVENTION

First Exemplary Embodiment

Hereinafter, a first exemplary embodiment of the present invention is described in detail with reference to the drawings. Meanwhile, herein, a case in which the invention is applied to an ink-jet recording device is described.

Figure 1:
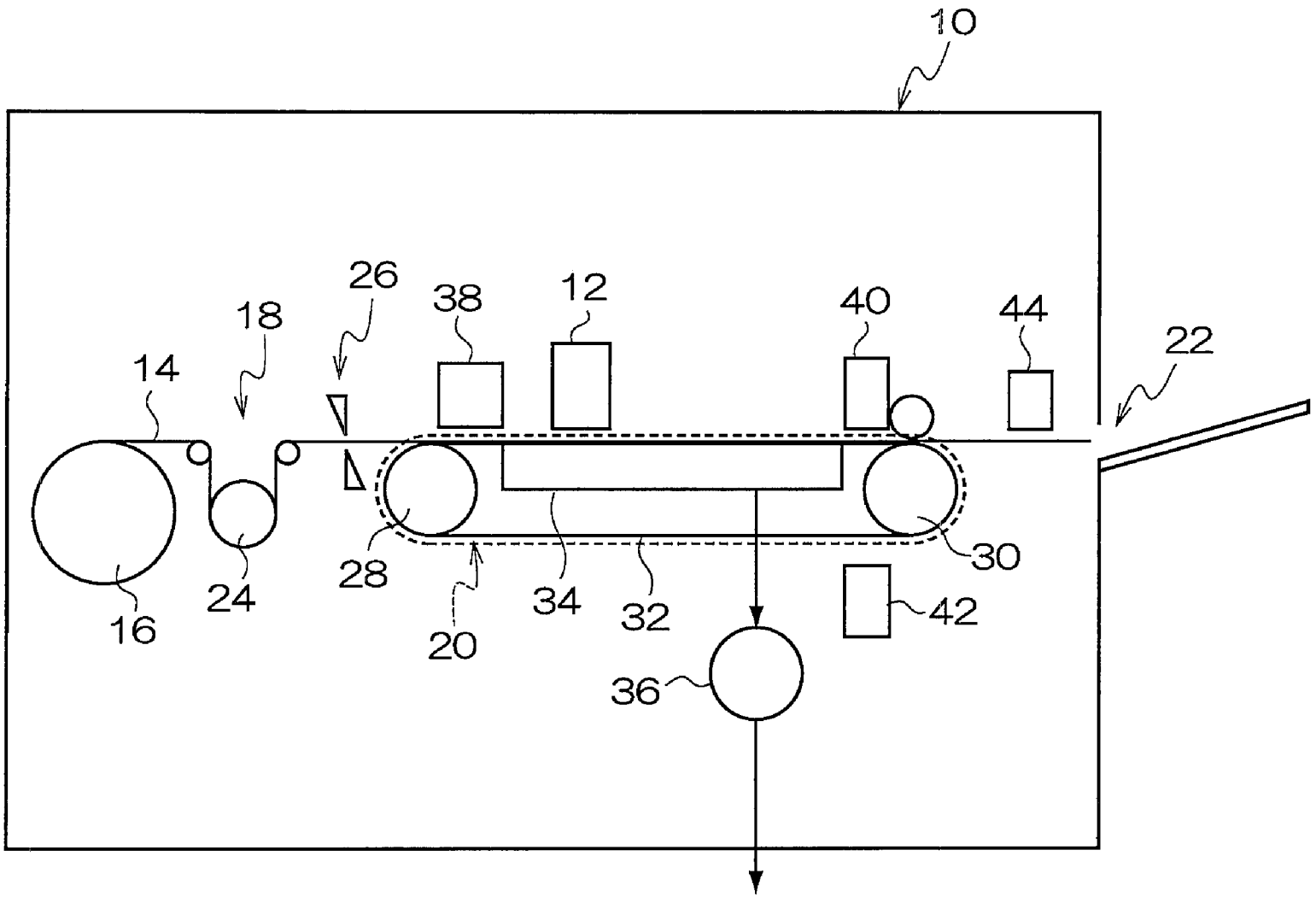
FIG. 1 is a broken side view showing a configuration of an ink-jet recording device according to a first exemplary embodiment.

FIG. 1 shows an entire configuration of an ink-jet recording device 10 according to this exemplary embodiment.

As shown in this figure, the ink-jet recording device 10 is provided with an image forming unit 12 having a recording head with plural nozzles for forming dots composing an image on a recording paper 14 by discharging ink droplets, a paper feeding unit 16 for feeding the recording paper 14, a decurling unit 18 for removing a curl of the recording paper 14, a belt conveyance unit 20 arranged so as to face a surface on which the ink droplets are discharged from the recording head provided on the image forming unit 12 (hereinafter, referred to as an "ink discharge surface") for conveying the recording paper 14 while holding planarity of the recording paper 14, an image reading unit 44 for reading the image formed on the recording paper 14, and a paper ejecting unit 22 for ejecting the recording paper 14 on which the image is formed.

Meanwhile, although the ink-jet recording device 10 according to this exemplary embodiment applies a roll paper (continuous form paper) magazine as the paper feeding unit 16, the paper feeding unit is not limited to this, and plural magazines with different paper widths and paper qualities may be applied. Also, a cassette on which cut paper is loaded in a stacked fashion may be applied in place of or in addition to the roll paper magazine.

Meanwhile, in a case of a configuration capable of using plural types of recording paper 14, it is preferable to attach an information recording medium such as a bar-code or a wireless tag in which type information of the recording paper 14 is recorded to the magazine and read the information in the information recording medium by a predetermined reading device, thereby automatically judging the type of the recording paper 14 to be used and performing an ink discharge control so as to realize appropriate ink discharge depending on the type.

A curl due to the loading on the magazine remains on the recording paper 14 fed from the paper feeding unit 16, and the recording paper 14 curls. In order to remove the curl, in the decurling unit 18, heat is applied to the recording paper 14 by a heating drum 24 in a direction opposite to a curl direction of the magazine. At that time, it is more preferable that a heating temperature is controlled such that the recording paper 14 softly curls with a surface on which the image is formed (hereinafter, referred to as an "image forming surface") outside.

In a case of a device configuration using the roll paper, as shown in FIG. 1, a cutter 26 for cutting is provided, and the roll paper is cut into a desired size with the cutter 26. Meanwhile, the cutter 26 is not required when using the cut paper.

After a decurling process, the recording paper 14 cut with the cutter 26 is fed to the belt conveyance unit 20.

The belt conveyance unit 20 is configured to have a configuration in which an endless belt 32 is mounted on rollers 28 and 30. By transmission of power of a motor not shown to at least one of the rollers 28 and 30 on which the belt 32 is mounted, the belt 32 is driven in a clockwise direction on FIG. 1, and the recording paper 14 held on the belt 32 is conveyed from left to right on FIG. 1.

Meanwhile, the belt 32 has a width wider than that of the recording paper 14, and numerous suction holes (not shown) are formed on a belt surface. As shown in this figure, on an inner side of the belt 32 mounted on the rollers 28 and 30, an absorption chamber 34 is provided on a position facing the ink discharge surface, and the recording paper 14 is absorbed and held on the belt 32 by sucking air in the absorption chamber 34 by a fan 36 to apply a negative pressure. Meanwhile, although the ink-jet recording device 10 according to this exemplary embodiment applies a suction absorption method using the absorption chamber 34 as a method to hold the recording paper 14 on the belt 32, the method is not limited to this, and an electrostatic absorption method for electrostatically absorbing the recording paper 14 on the belt 32 may be applied.

Also, a heating fan 38 is provided on an upstream side of the image forming unit 12 in a conveyance direction of the recording paper 14 by the belt conveyance unit 20. The heating fan 38 blows heated air on the recording paper 14 before forming the image to heat the recording paper 14. By heating the recording paper 14 just before forming the image, the ink droplets put on the recording paper 14 is easily dried.

A subsequent drying unit 40 provided with the heating fan to blow hot wind is provided on a subsequent stage of the image forming unit 12, and the image forming surface of the recording paper 14 on which the image is formed is dried by the subsequent drying unit 40, and thereafter, the recording paper 14 on which the image is formed is ejected from the paper ejecting unit 22.

In addition, since the ink droplets discharged from the image forming unit 12 might adhere also to the belt 32, a belt cleaning unit 42 is provided on the belt 32 outside of an area on which the recording paper 14 is conveyed. Meanwhile, although the ink-jet recording device 10 according to this exemplary embodiment applies a brush roll as the belt cleaning unit 42, the belt cleaning unit is not limited to this, and a water absorption roll, an air blow for blowing clean air, or a combination thereof may be applied.

The image reading unit 44 has a solid-state imaging device and is provided with respect to the conveyance area of the recording paper 14 between the subsequent drying unit 40 and the paper ejecting unit 22 such that an imaging surface of the solid-state imaging device faces the image forming surface of the recording paper 14. The image reading unit 44 reads, the image formed on the conveyed recording paper 14 by the solid-state imaging device to generate data indicating the read image (hereinafter, referred to as "read image data").

Meanwhile, although the ink-jet recording device 10 according to this exemplary embodiment applies a Charge Coupled Device (CCD) line sensor as the solid-state imaging device, the solid-state imaging device is not limited to this, and another solid-state imaging device such as a CCD area sensor, or Complementary Metal Oxide Semiconductor (CMOS) image sensor may be applied.

Although the ink-jet recording device 10 according to this exemplary embodiment applies a method to fix a disposing position of the solid-state imaging device to read the image formed on the conveyed recording paper 14, a method is not limited to this, and a method to read the image formed on the recording paper 14 by stopping to convey the recording paper 14 once when the recording paper 14 is conveyed to the disposing position of the image reading unit 44 and moving the solid-state imaging device in the conveyance direction of the recording paper 14 may be applied.

Figure 2:
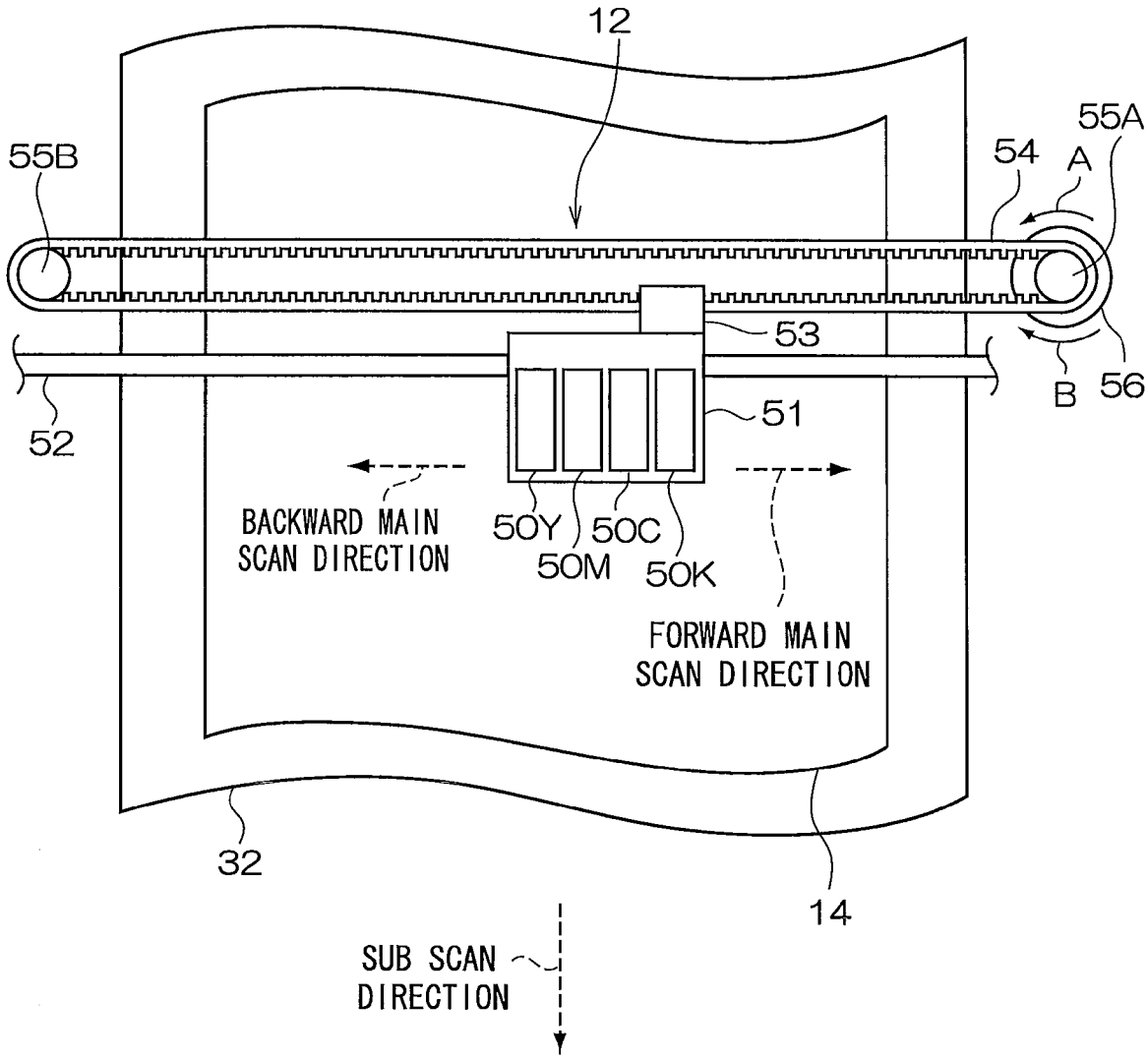
FIG. 2 is a top view of an image forming unit according to the first exemplary embodiment and a periphery thereof.

FIG. 2 shows a top view of the image forming unit 12 provided on the ink-jet recording device 10 according to this exemplary embodiment and a periphery thereof.

As shown in this figure, the image forming unit 12 is provided with a recording head 50Y for forming the image on the recording paper 14 by using yellow (Y) ink liquid, a recording head 50M for forming the image on the recording paper 14 by using magenta (M) ink liquid, a recording head 50C for forming the image on the recording paper 14 by using cyan (C) ink liquid, and a recording head 50K for forming the image on the recording paper 14 by using black (K) ink liquid, and the recording heads 50Y, 50M, 50C, and 50K are mounted on a carriage 51. Also, each of the respective recording heads 50Y, 50M, 50C, and 50K is provided with an ink tank filled with the ink liquid of corresponding color, respectively. Meanwhile, in a following description, when the corresponding colors are distinguished from one another, any of Y, M, C, and K corresponding is attached to an end of the reference numeral, and when the corresponding colors are not distinguished from one another, Y, M, C, and K are omitted.

The carriage 51 is provided with an insertion hole in the vicinity of an upper end portion on FIG. 2, and a guide rail 52 disposed so as to be parallel to a main scan direction is inserted into the insertion hole. Thereby, the carriage 51 is allowed to slide along the guide rail 52. Meanwhile, so-called allowance is provided in the insertion hole by making an inner diameter thereof a little larger than an outer diameter of the guide rail 52.

The carriage 51 is provided with a belt connecting unit 53 on the upper end portion on FIG. 2 (right end portion on FIG. 2 of an end surface of a side into which the guide rail 52 is inserted, in this exemplary embodiment) and is connected to a carriage belt 54 arranged so as to be parallel to the main scan direction by the belt connecting unit 53. Then, the carriage 51 moves back and forth in the main scan direction along the guide rail 52 by force applied according to a rotational direction by the rotation of the carriage belt 54.

Also, the carriage belt 54 is mounted on a driving pulley 55A and a driven pulley 55B. The driving pulley 55A is mechanically connected to a rotational shaft of the carriage motor 56 and positively and negatively rotates in accordance with a positive rotation (in a direction indicated by an arrow A in FIG. 2) and a negative rotation (in a direction indicated by an arrow B in FIG. 2) of the rotational shaft of the carriage motor 56. Therefore, the carriage belt 54 rotates in accordance with the positive rotation and the negative rotation of the rotational shaft of the carriage motor 56, and thereby, the carriage 51 moves back and forth in the main scan direction along the guide rail 52.

Meanwhile, the ink-jet recording device 10 according to this exemplary embodiment moves the carriage 51 forward in the main scan direction by positively rotating the rotational shaft of the carriage motor 56, and moves the carriage 51 backward in the main scan direction by negatively rotating the rotational shaft of the carriage motor 56.

Next, a structure of the recording head 50 is described.

Figure 3:
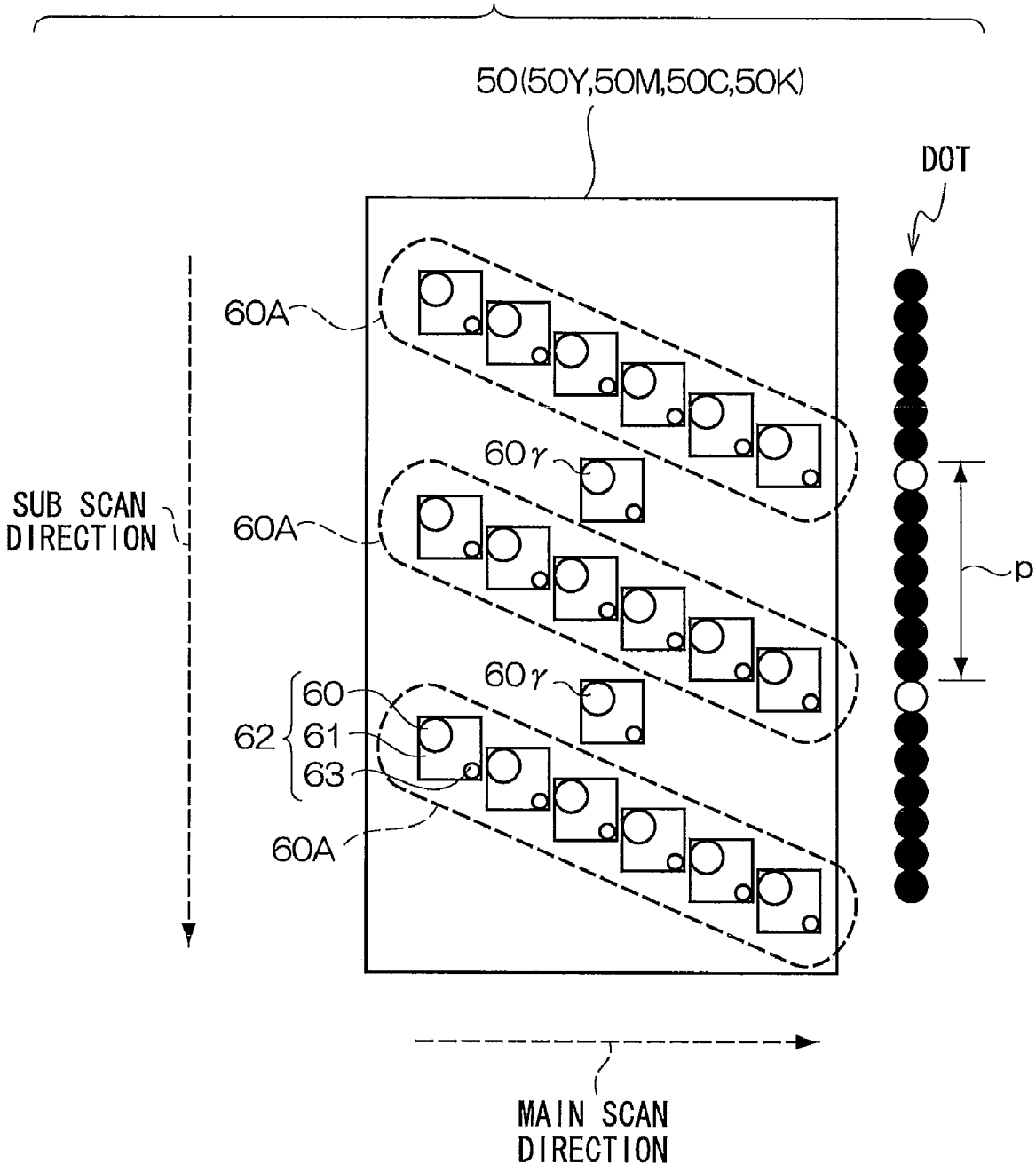
FIG. 3 is a perspective plan view showing a structure of a recording head according to the first exemplary embodiment.
Figure 4:
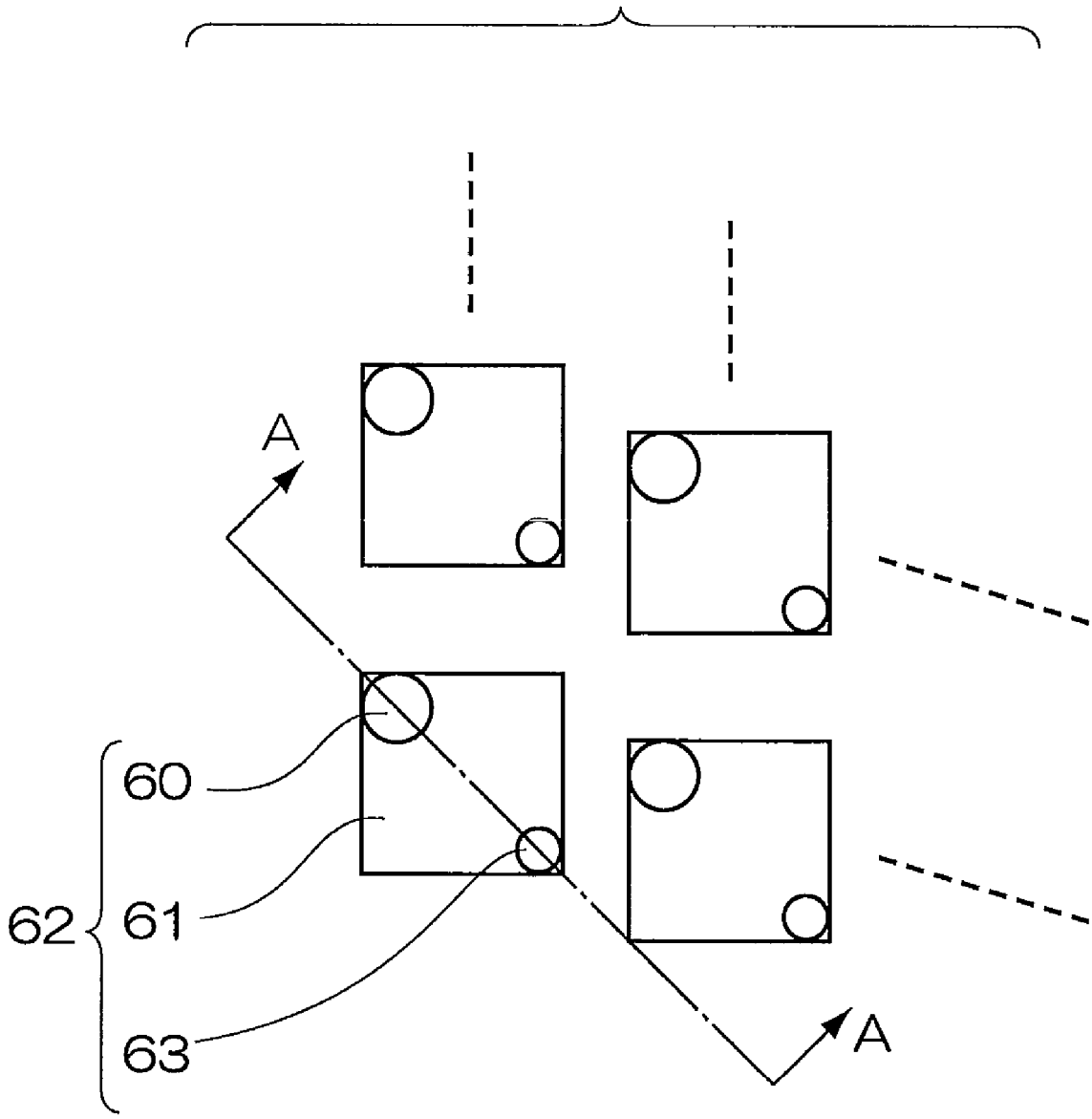
FIG. 4 is an enlarged view of the perspective plan view of a nozzle portion of the recording head according to the first exemplary embodiment.

FIG. 3 shows a perspective plan view showing a structural example of the recording head 50. In addition, FIG. 4 shows an enlarged view of a nozzle portion of the recording head 50.

In order to obtain high-density pitch of dots composing the image formed on the recording paper 14, it is required to obtain high-density pitch of plural nozzles provided on the recording head 50. For this purpose, the recording head 50 has a structure in which plural ink chamber units 62 formed of a nozzle 60, a pressure chamber 61 corresponding to the respective nozzles 60 or the like are arranged in a two-dimensional (matrix) matter, as shown in FIG. 3.

Meanwhile, in the recording head 50 provided on the inkjet recording device 10 according to this exemplary embodiment, plural (three, in this exemplary embodiment) nozzle groups 60A in which plural (six, in this exemplary embodiment) nozzles 60 are arranged on a straight line inclined with respect to the main scan direction at a predetermined angle are arranged in a sub scan direction such that intervals in the sub scan direction between the nozzles 60 adjacent in the sub scan direction are substantially identical and positions in the sub scan direction of the nozzles 60 belonging to the respective nozzle groups 60A are substantially identical, and further, a correction nozzle 60γ is provided in the respective nozzle groups 60A between adjacent nozzles between nozzle groups 60A adjacent in the sub scan direction, and on a substantially central portion in the main scan direction between the nozzles, so as not to overlap with other nozzles in the main scan direction. Meanwhile, the correction nozzle 60γ according to this exemplary embodiment is provided on a position at which intervals in the sub scan direction in the sub scan direction between the same and nozzles 60 adjacent on the upstream side and on the downstream side in the sub scan direction are substantially identical to intervals in the sub scan direction of the nozzles 60 belonging to the respective nozzle groups 60A.

Thereby, by realizing high-density substantial nozzle interval projected so as to be arranged along the sub scan direction (hereinafter, referred to as a "projected nozzle pitch"), the high-density dot pitch is obtained. Meanwhile, hereinafter, a width in the sub scan direction of a dot forming area by one nozzle group 60A and correction nozzle 60γ is referred to as a folded pitch P.

Also, the pressure chamber 61 provided so as to correspond to the respective nozzles 60 is square in a planar shape (refer to FIGS. 3 and 4), and is provided with the nozzle 60 on one of corners on a diagonal line (A-A line in FIG. 4) and with an inflow opening of fed ink (hereinafter, referred to as a "feed opening") 63 on the other of the corners.

Meanwhile, although the ink-jet recording device 10 according to this exemplary embodiment applies square as the planar shape of the pressure chamber 61, the shape is not limited to this, and other planar shapes such as another quadrangle such as rhombus and rectangle, pentagon, hexagon, another polygon, circle, and oval may be applied.

Figure 5:
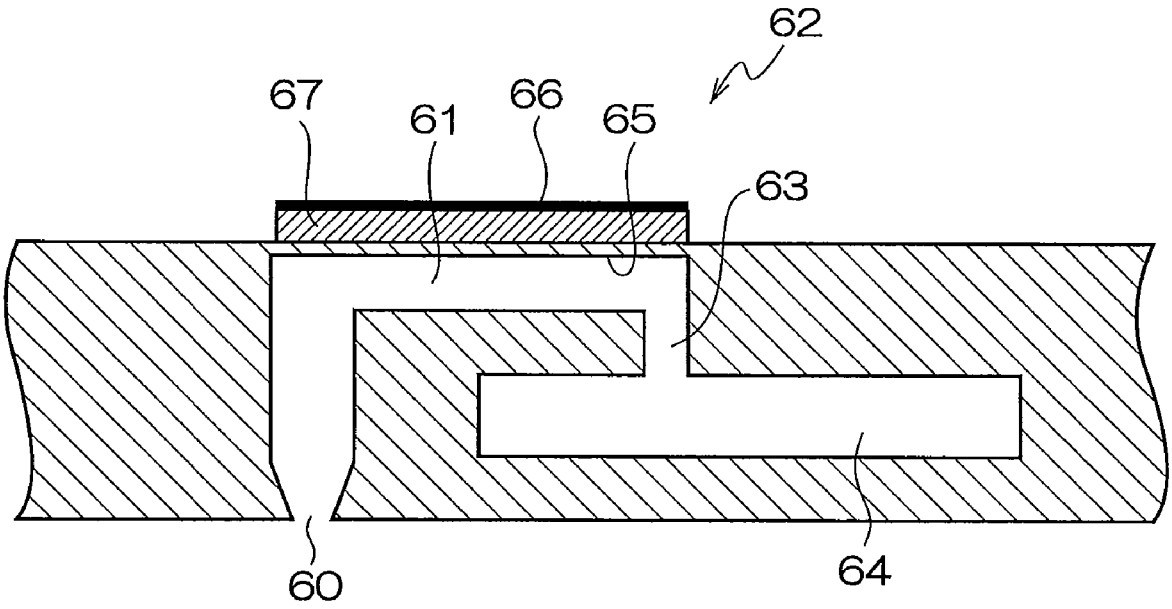
FIG. 5 is a broken side view of an ink chamber unit of the recording head according to the first exemplary embodiment.

FIG. 5 shows a broken side view of the ink chamber unit 62 along the A-A line in FIG. 4.

As shown in this figure, the respective pressure chambers 61 are communicated with a common flow path 64 through the feed opening 63. The common flow path 64 is communicated with the ink tank provided on the recording head 50, and the ink fed from the ink tank is distributed and fed to the respective pressure chambers 61 through the common flow path 64.

An actuator 67 provided with an individual electrode 66 is joined to a pressure plate (diaphragm also used as a common electrode) 65 forming a surface (top surface in FIG. 5) of a potion of the pressure chamber 61. By applying driving voltage between the individual electrode 66 and the common electrode, the actuator 67 deforms and a volume of the pressure chamber 61 changes, and the ink droplets are discharged from the nozzle 60 by the change in pressure associated with this. Then, after the discharge of the ink droplets, when displacement of the actuator 67 returns to the original state, the pressure chamber 61 is refilled with new ink from the common flow path 64 through the feed opening 63. Meanwhile, the ink-jet recording device 10 according to this exemplary embodiment applies a piezoelectric element using a piezoelectric body such as lead zirconium titanate and barium titanate as the actuator 67.

Figure 6:
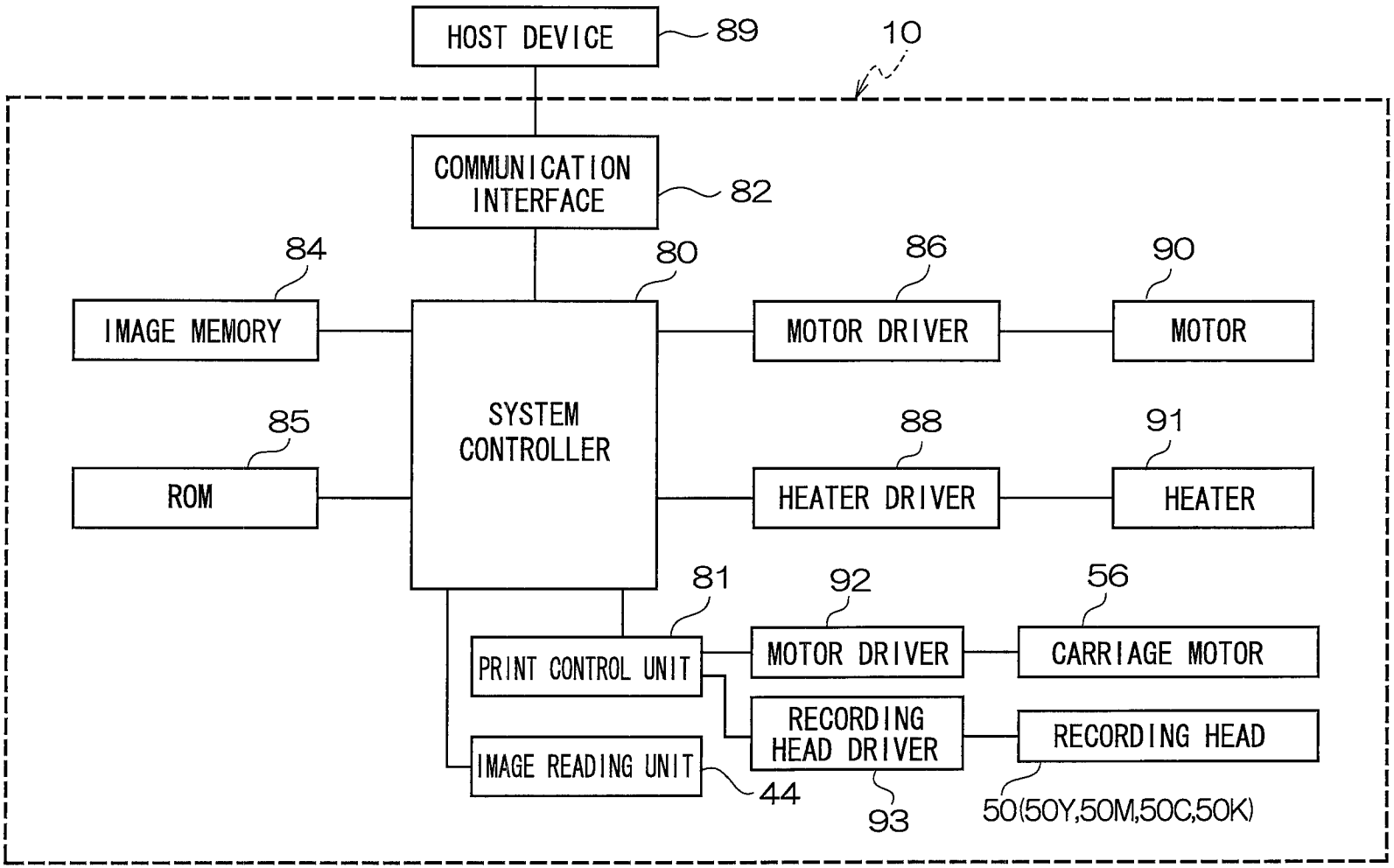
FIG. 6 is a block diagram showing a substantial configuration of an electrical system of the ink-jet recording device according to the first exemplary embodiment.

FIG. 6 is a block diagram showing an electric configuration of the ink-jet recording device 10. As shown in this figure, the ink-jet recording device 10 is provided with a system controller 80, a print control unit 81, a communication interface 82, an image memory 84, a Read Only Memory (ROM) 85, a motor driver 86, a heater driver 88, a motor driver 92, and a recording head driver 93.

The system controller 80 is composed of a Central Processing Unit (CPU) and a peripheral circuit thereof, and serves as a control device for controlling an entire ink-jet recording device 10 according to a predetermined program and serves as an arithmetic device for carrying out various arithmetic operations. That is to say, the system controller 80 controls the print control unit 81, the communication interface 82, the image memory 84, the ROM 85, the motor driver 86, the heater driver 88, and the image reading unit 44 in order to control the communication with a host device 89 and to control read and write of the image memory 84 and the ROM 85, and generates a control signal in order to control a motor 90 and a heater 91 of a conveyance system. Meanwhile, when controlling for forming the image on the recording paper 14, various data such as image data stored in the image memory 84 is transmitted to the print control unit 81. Also, read image data generated by the image reading unit 44 is received from the image reading unit 44.

The communication interface 82 is an interface unit with the host device 89 used by the user to instruct the ink-jet recording device 10 to form the image, and has a buffer memory for realizing high-speed communication. Meanwhile, although the ink-jet recording device 10 according to this exemplary embodiment applies a Universal Serial Bus (USB) as the communication interface 82, the interface is not limited to this, and a serial interface such as an Institute of Electrical and Electronics Engineers (IEEE) 1394, an Ethernet (trademark), and a wireless network, and a parallel interface such as Centronics may be applied.

The image memory 84 is storing unit for storing the image data transmitted from the host device 89 through the communication interface 82, and the read image data transmitted from the image reading unit 44, and the like, and various data is read and written by means of the system controller 80. Also, the image memory 84 is used as a temporary storage area of the various data and is used as a program development area and an arithmetic work area of the CPU. Meanwhile, although the ink-jet recording device 10 according to this exemplary embodiment applies the memory composed of a semiconductor device as the image memory 84, the memory is not limited to this, and a magnetic medium such as a hard disk may be applied.

Also, the program executed by the CPU of the system controller 80 and various data necessary for the control are stored in the ROM 85. Meanwhile, although the ink-jet recording device 10 according to this exemplary embodiment applies unrewritable storage unit as the ROM 85, the ROM is not limited to this, and rewritable storage unit such as an Electrically Erasable Programmable Read Only Memory (EEPROM) may be applied.

The motor driver 86 is a driving circuit for driving the motor 90 of the conveyance system according to the instruction from the system controller 80, and the heater driver 88 is the driver for driving the heater 91 of the subsequent drying unit 40 or the like according to the instruction from the system controller 80.

The print control unit 81 serves as signal processing unit for performing processes such as various treatments and corrections for generating data for controlling the ink discharge (hereinafter, referred to as "ink discharge data") from the image data transmitted from the system controller according to the control of the system controller 80, and controls the recording head 50 through the recording head driver 93, and controls a carriage motor 56 through a motor driver 92, which is the driving circuit for driving the carriage motor 56.

The recording head driver 93 is the driving circuit for driving the recording head 50 according to the instruction from the print control unit 81, and generates the driving voltage for allowing the nozzle 60 to discharge the ink droplets based on the ink discharge data transmitted from the print control unit 81 to output to the recording head 50.

Herein, a density distribution in the sub-scan direction of the dots formed by the conventional ink-jet recording device is described with reference to FIGS. 7A and 7B. Meanwhile, a recording head 50' shown in FIGS. 7A and 7B provided on the conventional ink-jet recording device does not have the correction nozzle 60γ, and it is described, assuming that the number of nozzles 60' composing one nozzle group 60'A is seven as one example, and that the number of nozzle groups 60'A is three as one example.

Figure 7A:
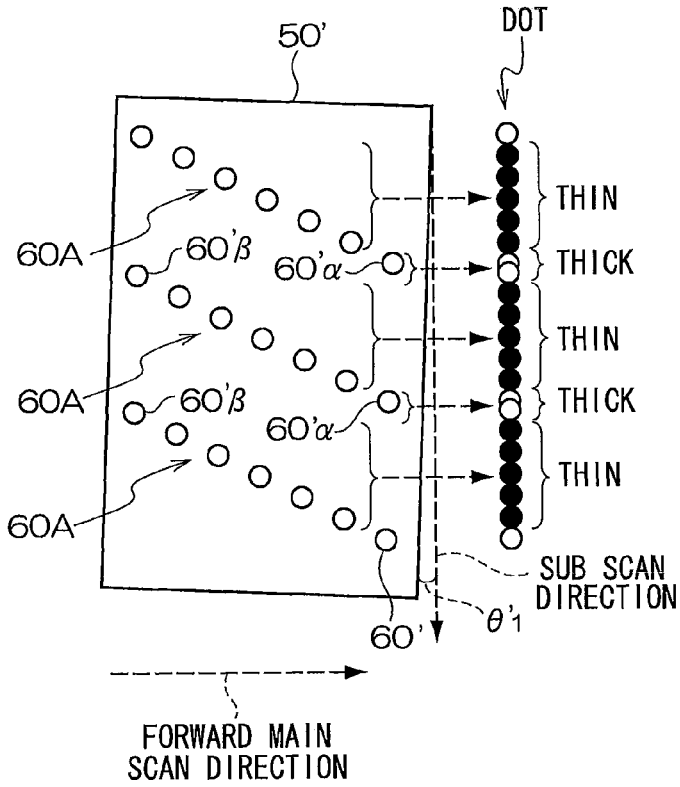
FIGS. 7A and 7B are views for illustrating a state of inclination of the recording head provided on the ink-jet recording device according to a conventional embodiment and density distribution of formed dots.

As shown in FIG. 7A, there is a case in which the recording head 50' provided on the carriage moves while being inclined such that an upstream side portion thereof in the sub scan direction gets behind a downstream side portion thereof in the sub scan direction when this moves forward in the main scan direction. This is because the allowance is provided in the insertion hole such that the carriage smoothly moves back and forth in the main scan direction along the guide rail.

When the recording head 50' moves forward while being inclined at an angle $\theta'_1$, a projected nozzle pitch in the sub scan direction of adjacent nozzles 60'α and 60'β between nozzle groups 60'A adjacent in the sub scan direction (hereinafter, referred to as "adjacent nozzles") out of plural nozzles 60' composing the nozzle group 60'A (hereinafter, referred to as "projected adjacent nozzle pitch") becomes shorter than that in a case in which the recording head 50' is not inclined, and on the other hand, a projected nozzle pitch in the sub scan direction of the nozzles other than the adjacent nozzles 60'α and 60'β (hereinafter, referred to as "intermediate portion nozzles") (hereinafter, referred to as "projected intermediate portion nozzle pitch") becomes longer than in a case in which the recording head 50' is not inclined. Thereby, the density in the sub scan direction of the dots formed by the adjacent nozzles 60'α and 60'β becomes thick, and on the other hand, the density in the sub scan direction of the dots formed by the intermediate portion nozzles becomes thin.

Figure 7B:
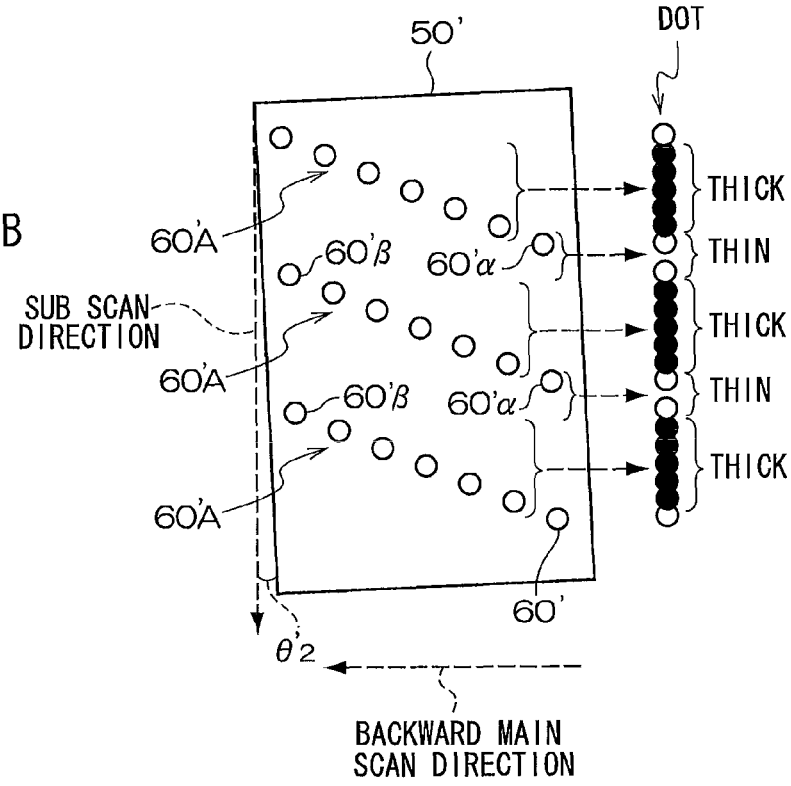

On the other hand, as shown in FIG. 7B, there is a case in which the recording head 50' provided on the carriage moves while being inclined such that the downstream side portion thereof in the sub scan direction gets behind the upstream side portion thereof in the sub scan direction when this moves backward in the main scan direction, for the same reason as in the case of moving forward in the main scan direction.

When the recording head 50' moves backward while being inclined at an angle $\theta'_2$, the projected adjacent nozzle pitch becomes longer than in a case in which the recording head 50' is not inclined, and on the other hand, the projected intermediate portion nozzle pitch becomes shorter than in a case in which the recording head 50' is not inclined. Thereby, the density in the sub scan direction of the dots formed by the adjacent nozzles 60'α and 60'β becomes thin, and on the other hand, the density in the sub scan direction of the dots formed by the intermediate portion nozzles becomes thick.

Meanwhile, as described above, the carriage is not only inclined in the direction opposed to the moving direction of the carriage, but also inclines in the same direction as the moving direction of the carriage. Also, the angles $\theta'_1$ and $\theta'_2$ might be different or might be identical. In addition, each of the respective recording heads 50' is separately attached to the carriage, so that the angles $\theta'_1$ and $\theta'_2$ might be different for the respective recording heads 50'.

When the carriage moves back and forth in the main scan direction while being inclined in this manner, concentration unevenness occurs in the sub scan direction of the image formed by the recording head 50'.

The density distribution of the dots formed by the ink-jet recording device 10 according to this exemplary embodiment is described with reference to FIGS. 8A and 8B.

Figure 8A:
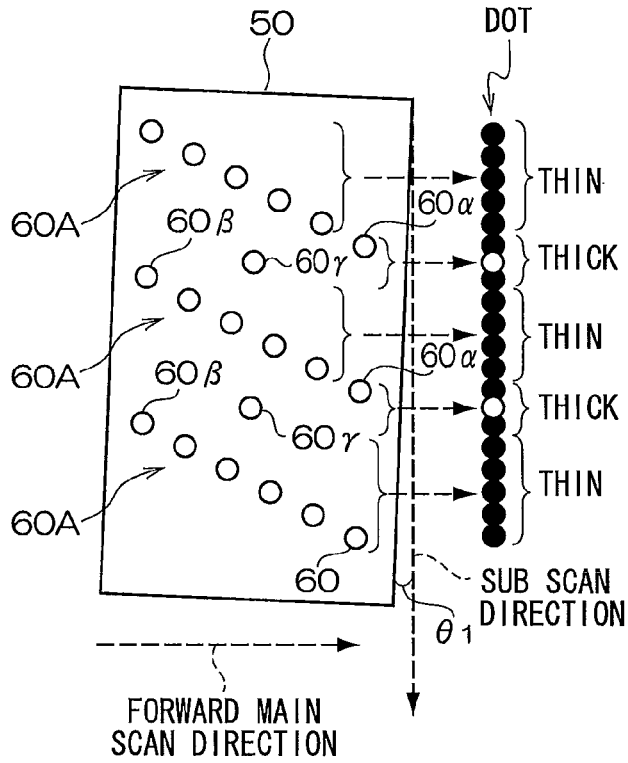
FIGS. 8A and 8B are views for illustrating a state of inclination of the recording head according to the first exemplary embodiment and density distribution of formed dots.
Figure 8B:
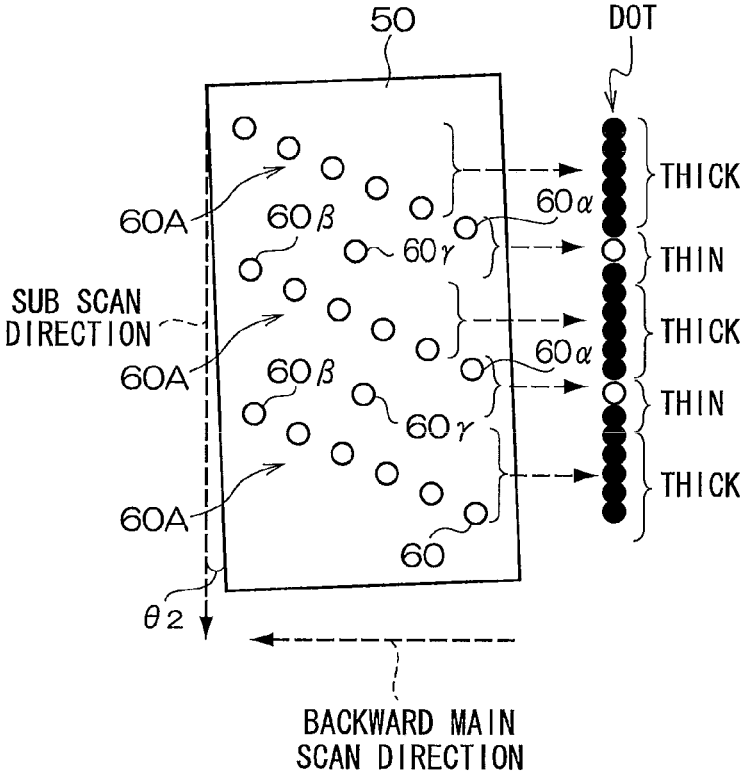

As shown in FIGS. 8A and 8B, since the allowance is provided in the insertion hole of the carriage 51, the recording head 50 provided on the carriage 51 might move with a head posture inclined when this moves back and forth in the main scan direction, as in the case of the conventional recording head 50'.

Herein, when an inclination angle of the recording head provided with the correction nozzle 60γ as the recording head 50 according to this exemplary embodiment and an inclination angle of the recording head without the correction nozzle 60γ as the conventional recording head 50' (refer to FIGS. 7A and 7B) are the same, difference between the projected adjacent nozzle pitch and the projected intermediated portion nozzle pitch of the recording head 50 according to this exemplary embodiment becomes smaller than in the case of the conventional recording head 50'. Therefore, difference between the density of the dots formed by the adjacent nozzles 60α and 60β and the correction nozzle 60γ and the density of the dots formed by the intermediate portion nozzles of the recording head 50 according to this exemplary embodiment becomes smaller than in the case of the conventional recording head 50', so that the ink-jet recording device 10 according to this exemplary embodiment may reduce occurrence of the concentration unevenness in the sub scan direction of the formed image than in the case of the conventional ink-jet recording device.

However, in the recording head 50 according to this exemplary embodiment also, the occurrence of the concentration unevenness in the sub scan direction of the formed image is not always sufficiently reduced.

Therefore, the ink-jet recording device 10 according to this exemplary embodiment corrects an amount of ink droplets discharged from the correction nozzle 60γ so as to reduce the concentration unevenness.

Figure 9:
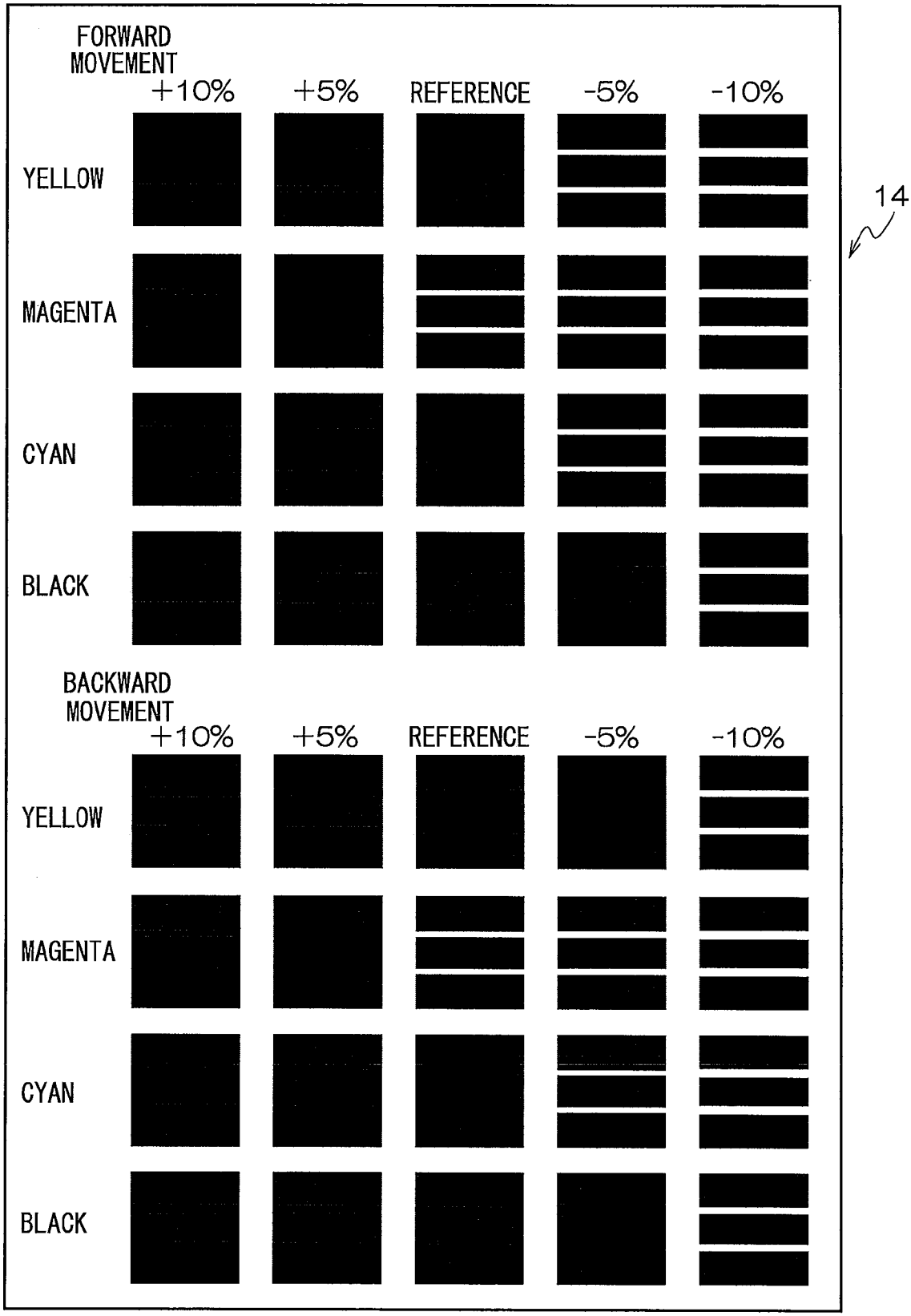
FIG. 9 is a schematic view showing one example of a test pattern formed by the ink-jet recording device according to the first exemplary embodiment.

In the inkjet recording device 10 according to this exemplary embodiment, as schematically shown in FIG. 9 as one example, a test pattern is formed for each of the forward movement and the backward movement of the carriage 51 in the main scan direction. Meanwhile, in the ink-jet recording device 10 according to this exemplary embodiment, image data capable of forming the test pattern (hereinafter, referred to as "test pattern data") is stored in advance in the storage area of the image memory 84.

As shown in this figure, the test pattern according to this exemplary embodiment is composed of solid images for each of the respective colors of Y, M, C, and K and for each amount of plural predetermined levels of ink droplets discharged from the correction nozzle 60γ, and in a state in which an amount of ink droplets discharged from another nozzle is set to a predetermined reference discharge amount. Meanwhile, although a total of five levels of ink discharge amounts, that is to say, the predetermined reference discharge amount and four levels of ink discharge amounts ±5% and ±10% from the reference discharge amount are applied as the amounts of the above plural levels of the ink droplets in the ink-jet recording device 10 according to this exemplary embodiment, it goes without saying that the amounts are not limited to them.

Meanwhile, the larger the inclination angles at the time of the movement back and forth of the recording head 50 with respect to the main scan direction, the larger a shift amount between the projected adjacent nozzle pitch and the projected intermediate portion nozzle pitch, so that, as schematically shown in this figure, when the projected adjacent nozzle pitch is narrower than the projected intermediate portion nozzle pitch, an image area corresponding to the adjacent nozzles 60α and 60β and the correction nozzle 60γ becomes thicker than other areas, and when the projected adjacent nozzle pitch is wider than the projected intermediate nozzle pitch, the image area corresponding to the adjacent nozzles 60α and 60β and the correction nozzle 60γ becomes thinner than other areas.

Therefore, by referring to the test pattern, increase and decrease amounts from the reference discharge amount of the image of which concentration unevenness in the sub scan direction is reduced the most may be specified as the correction amount of ink droplets discharged from the correction nozzle 60γ of each recording head, for each of the forward movement and the backward movement of the recording head 50 in the main scan direction.

Then, in the ink-jet recording device 10 according to this exemplary embodiment, data indicating the correction amount (hereinafter, referred to as "correction amount data") is stored in the storage area of the image memory 84 for each recording head 50 and for each of the forward movement and the backward movement in the main scan direction, and corrects the ink discharge data corresponding to the image to be formed is corrected by the correction amount data when forming the image on the recording paper 14, thereby controlling the discharge of the ink droplets by the recording head 50 while correcting the amount of the ink droplets discharged from the correction nozzle 60γ.

Figure 10:
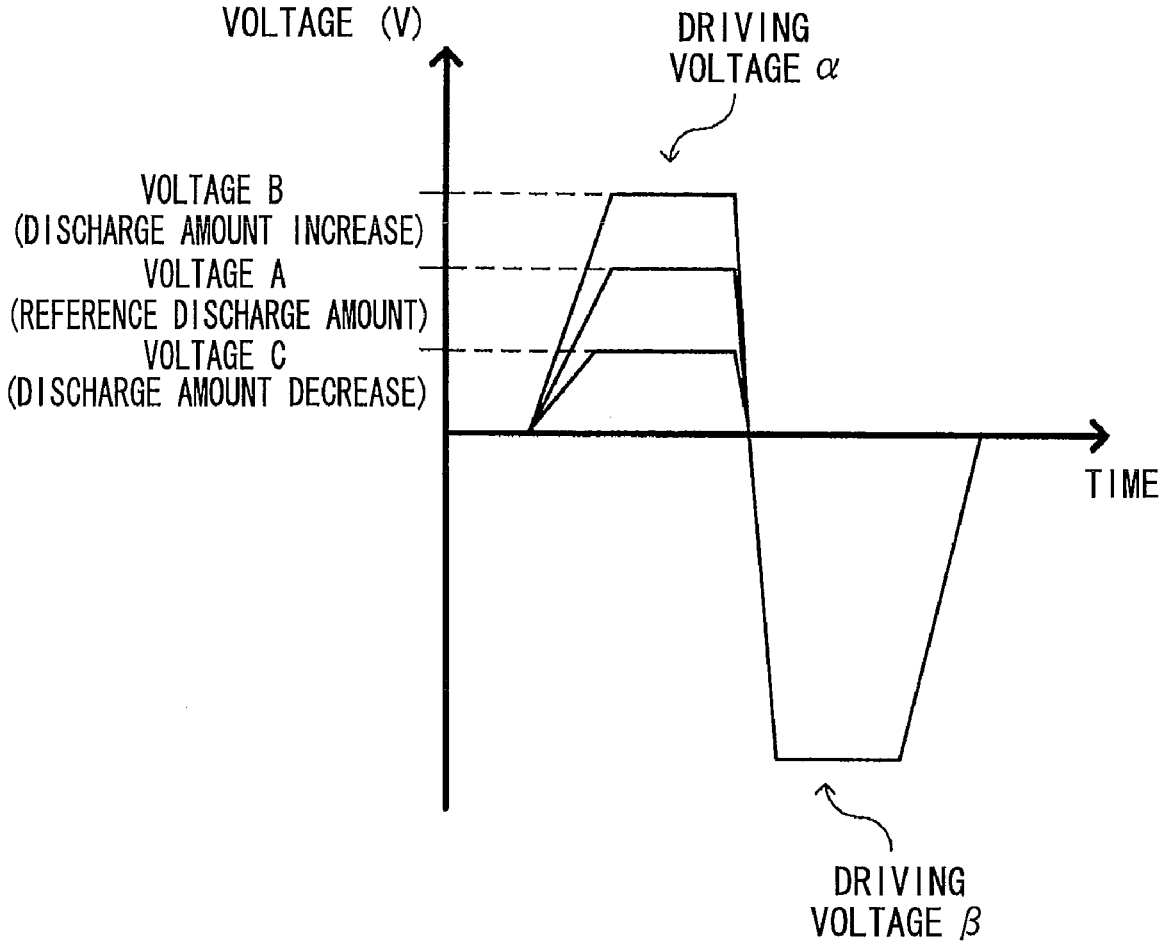
FIG. 10 is a view for illustrating driving voltage for deforming an actuator when discharging the ink droplets from the recording head according to the first exemplary embodiment.

Meanwhile, in the ink-jet recording device 10 according to this exemplary embodiment, as shown in FIG. 10, the actuator 67 is deformed by applying driving voltage α and driving voltage β of which polarity is opposite to that of the voltage α to the individual electrode 66 to discharge the ink droplets from the nozzle 60 (refer also to FIG. 5). Meanwhile, when the driving voltage α is applied to the individual electrode 66, the actuator 67 deforms such that a volume of the pressure chamber 61 expands, and an ink liquid surface on the nozzle 60 is drawn inside of the nozzle 60. When the driving voltage β is applied thereafter, the actuator 67 deforms in a direction opposite to that in a case in which the driving voltage α is applied and the volume of the pressure chamber 61 contracts, and the ink droplets are discharged from the nozzle 60.

When the driving voltage α is voltage A, the ink liquid is discharged from the nozzle 60 by the reference discharge amount, when the driving voltage α is voltage B, which is higher than the voltage A, the ink liquid is discharged from the nozzle 60 by the amount larger than the reference discharge amount, and when the driving voltage α is voltage C, which is lower than the voltage A, the ink liquid is discharged from the nozzle 60 by the amount smaller than the reference discharge amount.

That is to say, the print control unit 81 according to this exemplary embodiment corrects the amount of ink droplets discharged from the correction nozzle 60γ by correcting the volume of the driving voltage α, which deforms the actuator 67 corresponding to the correction nozzle 60γ based on the correction amount data.

Figure 11:
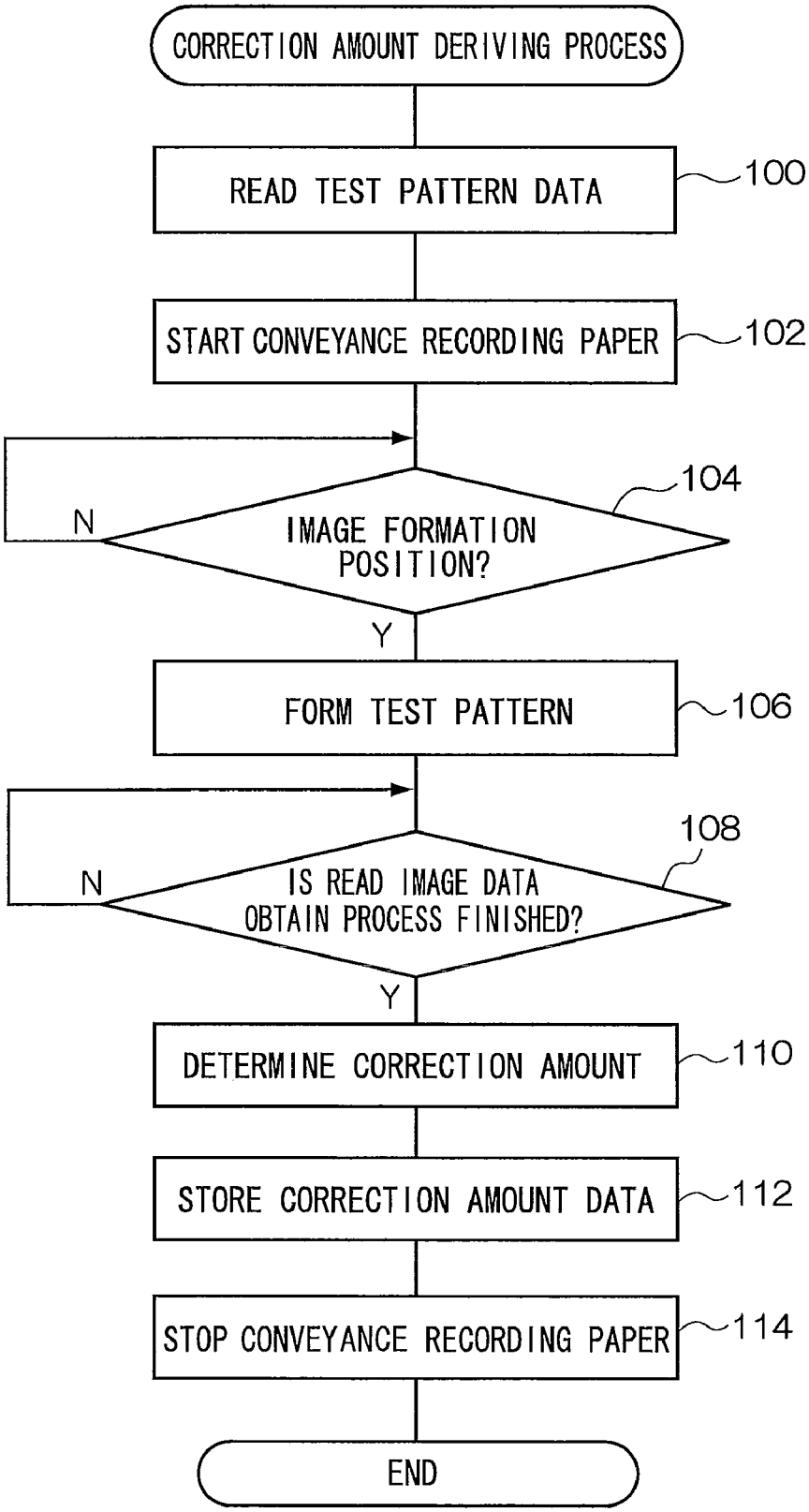
FIG. 11 is a flowchart showing a process flow according to the first exemplary embodiment.

Next, an operation of the ink-jet recording device 10 according to this exemplary embodiment is described with reference to FIG. 11. Meanwhile, this figure is a flowchart showing a process flow of a correction amount deriving program executed by the CPU of the system controller 80 when an instruction to derive the correction amount is received through the host device 89, for example, and the program is stored in the storing area of the ROM 85 in advance.

First, at a step 100 in this figure, the test pattern data is read from the image memory 84.

At a next step 102, the conveyance of recording paper 14 is started. Meanwhile, the curl of the recording paper 14 is removed by the decurling unit 18 and the recording paper 14 is cut into a desired size with the cutter 26.

At a next step 104, the device enters in a wait status until the recording paper 14 reaches the image forming position.

At a next step 106, the print control unit 81 is controlled so as to form the test pattern on the recording paper 14. Thereby, the print control unit 81 allows the recording head driver 93 to generate the driving voltage for the respective nozzles 60 based on the ink discharge data corresponding to the test pattern data, and allows the recording head 50 to discharge the ink droplets, thereby forming the test pattern on the recording paper 14.

At a next step 108, the image reading unit 44 reads the test pattern formed on the recording paper 14, and the device enters in a wait status until the read image data indicating the test pattern generated by the image reading unit 44 is obtained.

At a next step 110, the correction amount of ink droplets discharged from the correction nozzle 60γ based on the read image data indicating the obtained test pattern.

At a next step 112, the correction amount data indicating the determined correction amount is stored in the storage area of the image memory 84.

At a next step 114, the recording paper 14 on which the test pattern is formed is conveyed to the paper ejecting unit 22, the conveyance of the recording paper 14 is stopped, and the program is finished.

Figure 12:
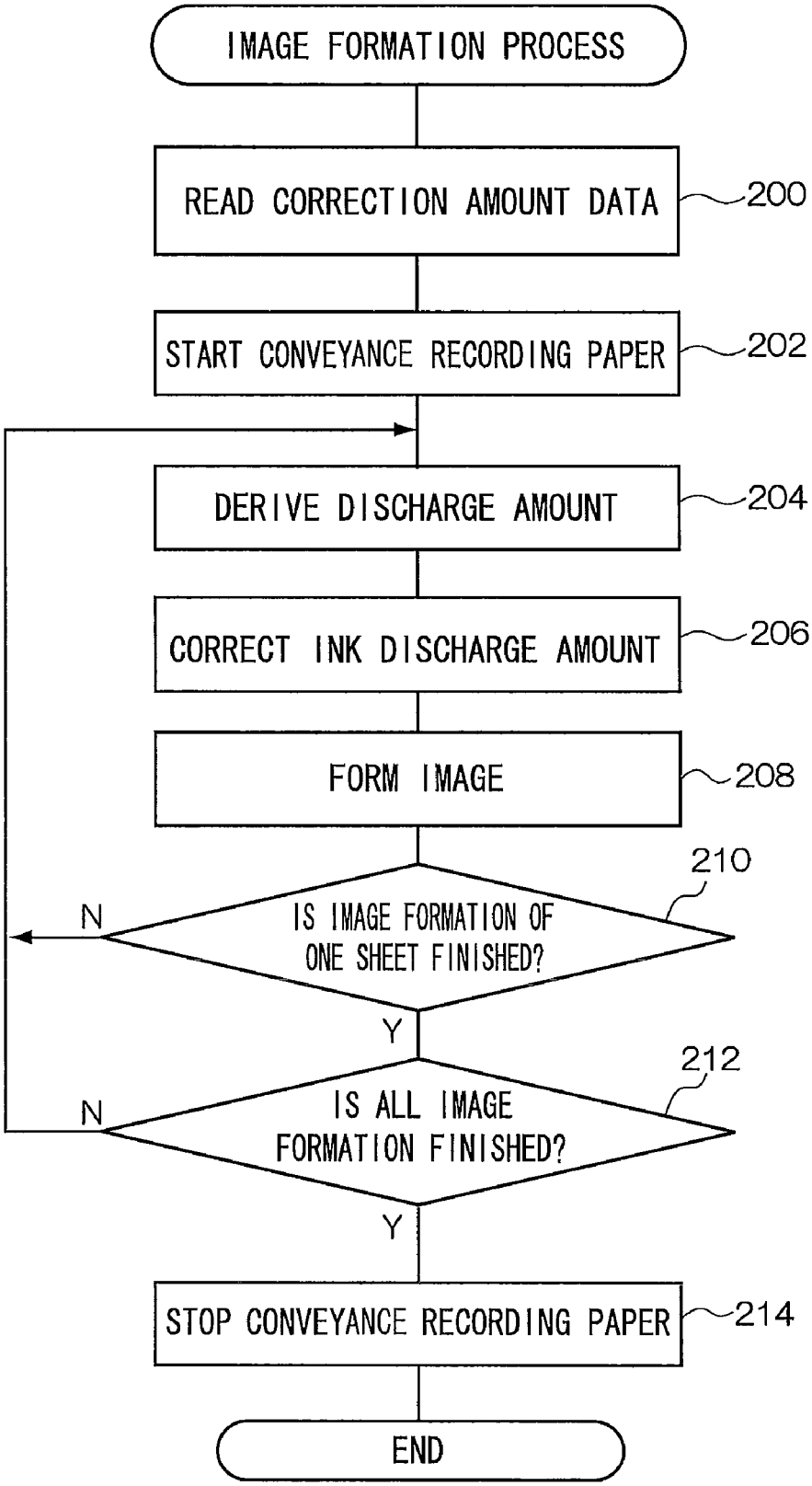
FIG. 12 is a flowchart showing a process flow of an image forming program according to the first exemplary embodiment.

Next, the image forming process by the ink-jet recording device 10 according to this exemplary embodiment is described with reference to FIG. 12. Meanwhile, this figure is a flowchart showing a process flow of the image forming program executed by the CPU of the system controller 80 when forming the image indicated by the image data, and the program is stored in advance in the storage area of the ROM 85.

First, at a step 200 in this figure, the correction amount data stored in the storage area of the image memory 84 is read.

At a next step 202, the conveyance of the recording paper 14 is started. Meanwhile, the curl of the recording paper 14 is removed by the decurling unit 18, and the recording paper 14 is cut into a desired size with the cutter 26.

At a next step 204, the amount of ink droplets discharged from the nozzle 60 for forming the image indicated by the image data is derived by the print control unit 81. Thereby, the print control unit 81 generates the ink discharge data corresponding to the image data.

At a next step 206, the discharge amount of the ink droplets is corrected by the print control unit 81. Thereby, the print control unit 81 corrects the amount of ink droplets discharged from the correction nozzle 60γ indicated by the ink discharge data based on the correction amount data.

At a next step 208, the ink discharge data is transmitted to the print control unit 81 to form the image indicated by the image data. Thereby, the print control unit 81 allows the recording head driver 93 to generate the driving voltage for driving the actuator 67 for each nozzle based on the discharge data. When the recording paper 14 reaches the image forming position, the generated driving voltage is applied to the individual electrode 66 to drive the actuator 67, thereby controlling the discharge of the ink droplets by the recording head 50 while correcting the amount of ink droplets discharged from the correction nozzle 60γ to form the image on the recording paper 14.

At a next step 210, it is judged whether the formation of the image of one sheet of the recording paper 14 is finished, and when the formation is judged to be not finished, the procedure returns back to the step 204, and when this is judged to be finished, the procedure shifts to a step 212.

At the step 212, it is judged whether the formation of the image is finished for all of the image data, which should form the image, and when the formation is judged to be not finished, the procedure returns back to the step 204, and when this is judged to be finished, the procedure shifts to a step 214.

At a next step 214, the recording paper 14 on which the image is formed is conveyed to the paper ejecting unit 22, the conveyance of the recording paper 14 is stopped, and the program is finished.

As is described in detail above, in this exemplary embodiment, plural nozzle groups includes plural nozzles that form dots, which makes up an image on a recording medium by discharging droplets. The nozzles are arranged in a straight line that is inclined with respect to the main scan direction at the predetermined angle. The nozzle groups are arranged in the sub scan direction such that the intervals in the sub scan direction between nozzles adjacent in the sub scan direction are substantially identical and positions in the sub scan direction of the nozzles belonging to the respective nozzle groups are substantially aligned. Furthermore, a second nozzle is disposed at a substantially central portion in the main scan direction between adjacent nozzles of nozzle groups adjacent in the sub scan direction so as not to overlap with any other nozzle in the main scan direction. Therefore, concentration unevenness in the sub scan direction of the formed image, which is occurred due to the head posture inclination when the matrix type recording head moves in the main scan direction, may be reduced without having the complicated configuration.

In this exemplary embodiment, the second nozzle is disposed at the position at which the intervals in the sub scan direction between the second nozzle and the nozzles, which are adjacent to the second nozzle upstream and downstream of the sub scan direction, are substantially equal to the intervals between the nozzles in the sub scan direction that belong to the respective nozzle groups. Therefore, the occurrence of the concentration unevenness in the sub scan direction of the image to be formed may be further reduced.

In this exemplary embodiment, there are provided that the moving unit that moves the recording head back and forth in the main scan direction, and the conveyance unit that relatively conveys at least one of the recording head and the recording medium in the sub scan direction. Further, there is provided the determination unit that determines the correction amount of droplets discharged from the second nozzle provided on the recording head so as to reduce the concentration unevenness in the sub scan direction of the image formed on the recording medium. Furthermore, there is provided the control unit that controls the discharge of the droplets by the recording head while correcting the amount of droplets discharged from the second nozzle based on the correction amount determined, when forming the image on the recording medium. Therefore, concentration unevenness of the formed image in the sub scan direction occurred due to the inclination of the head posture at the time of movement of the matrix type recording head in the main scan direction may be reduced, without having the complicated configuration.

In this exemplary embodiment, since the determination unit determines the correction amount according to each of the forward movement and the backward movement even when the inclination angles of the recording head are different to each other when the recording head is moved forward and moved backward in the main scan direction by the moving unit, the concentration unevenness of the formed image in the sub scan direction may be further reduced.

In this exemplary embodiment, there is further provided the reading unit that reads the concentration distribution in the sub scan direction of the test pattern including plural images formed by the recording head when the amounts of droplets discharged from the second nozzle are different from each other and the amounts of droplets discharged from another nozzle are identical, and the determination unit determines the correction amount based on the concentration distribution read result in the sub scan direction of the test pattern that is read by the reading unit. Therefore, more appropriate correction amount when forming the image may be determined.

In this exemplary embodiment, plural images are the images for each color, the reading unit reads the plural images for each color, and the determination unit determines the correction amount for each of the respective colors based on the read result by the reading unit. Therefore, the appropriate correction amount may be determined for each of the respective colors even when the inclination of the head posture of the recording head of each color subtly differs.

Figure 13:
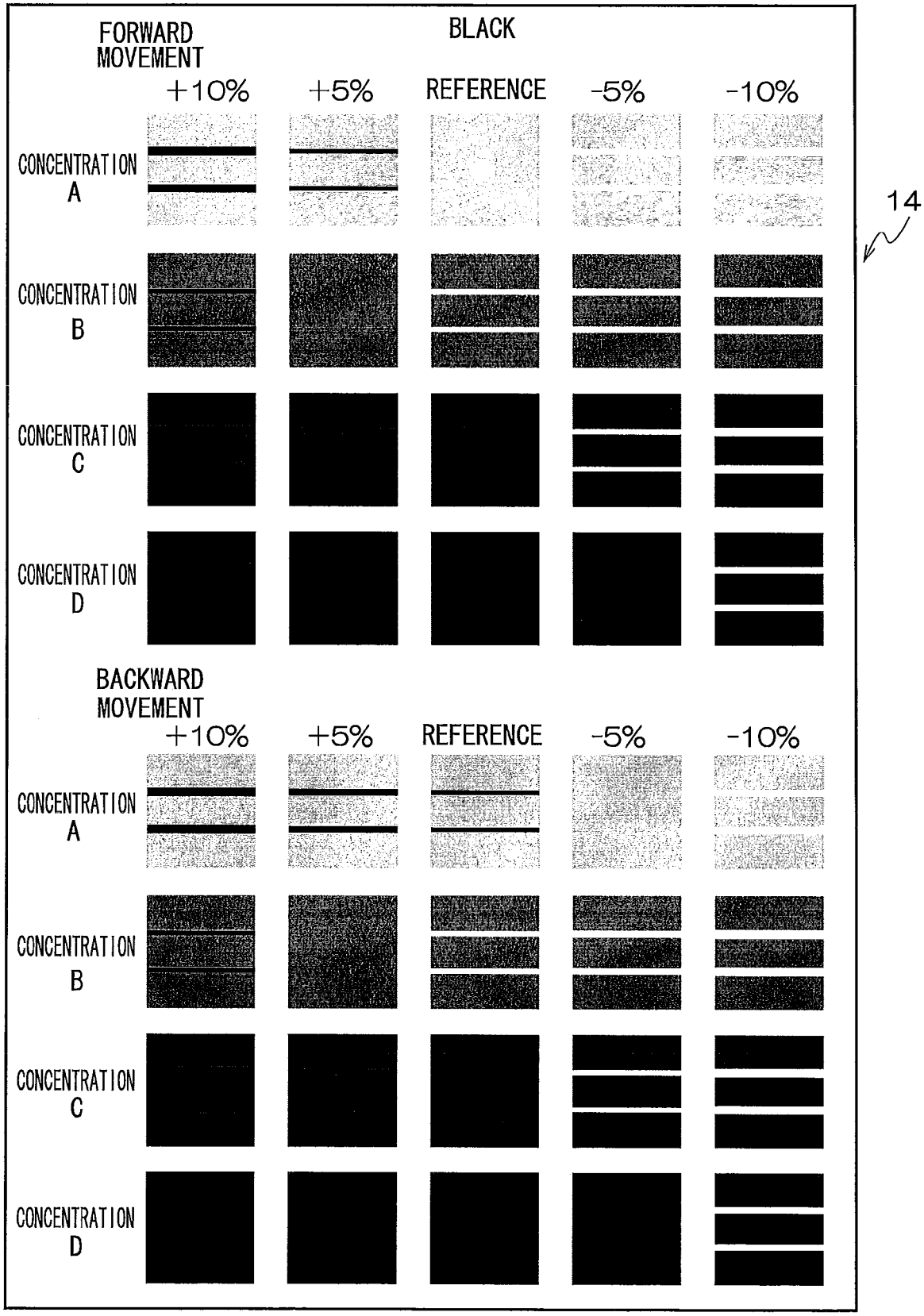
FIG. 13 is a schematic diagram showing one example of the test pattern formed by the ink-jet recording device according to another exemplary embodiment.

Also, although a case in which the test pattern shown in FIG. 9 is formed has been described in the exemplary embodiment, the invention is not limited to this, and an embodiment to form the test pattern including solid images for each concentration of plural levels for each of the respective colors of Y, M, C, and K as shown in FIG. 13 (test pattern shown in FIG. 13 corresponds to K), thereby determining the correction amount of ink droplets discharged from the correction nozzle 60γ for each concentration of colors of Y, M, C, and K is possible.

In a case of this embodiment, plural images formed on the test pattern are made images for each different concentration area, and the plural images are read for each of the respective concentration areas by the image reading unit 44, and the correction amount is determined for each of the respective concentration areas based on the read result by the image reading unit 44, so that the correction amount appropriate for a total droplet discharge amount per each area may be determined even in concentration area of which total droplet discharge amount per unit area is different.

Also, by correcting the amount of ink droplets discharged from the correction nozzle 60γ, there is a case in which the concentration unevenness in the sub scan direction occurs on a boundary between the correction nozzle 60γ and the nozzle of which amount of the ink discharged droplets is not corrected on the image formed on the recording paper 14. Therefore, in order to make the concentration distribution in the sub scan direction of the solid image formed on the recording paper 14 uniform, an embodiment to further determine the correction amount of ink droplets discharged from a predetermined number of nozzles in an ascending order of distance from the correction nozzle 60γ on the downstream side and the upstream side in the sub scan direction (as one example, one on the downstream side and on the upstream side in the sub scan direction, that is to say, the adjacent nozzles 60α and 60β), and corrects the amount of ink droplets discharged from the correction nozzle 60γ and the amount of ink droplets discharged by the predetermined number of nozzles based on each determined correction amount when forming the image on the recording paper 14, thereby controlling the discharge of the ink droplets by the recording head 50 is possible. Thereby, the occurrence of the concentration unevenness in the sub scan direction of the image to be formed may be further reduced.

In the embodiment, as a method of determining the correction amount of ink droplets discharged from a predetermined number of nozzles in an ascending order of distance from the correction nozzle 60γ on the downstream side and on the upstream side in the sub scan direction, a following method is applied, as one example. First, the correction amount of ink droplets discharged from the correction nozzle 60γ is determined. Thereafter, the test pattern including plural solid images formed by the recording head 50 is formed in a state in which the amount of ink droplets discharged from the correction nozzle 60γ is corrected by the previously determined correction amount, the amounts of ink droplets discharged from the predetermined number of nozzles are different from each other, and the amount of ink droplets discharged from another nozzle is made identical. Then, the correction amount corresponding to the predetermined number of nozzles is determined based on the amount of ink droplets discharged from the predetermined number of nozzles forming the image of which concentration unevenness in the sub scan direction is reduced based on the test pattern.

Although the amount of ink droplets discharged from the nozzle 60 is corrected by correcting the volume of the driving voltage α shown in FIG. 10 in the above-described exemplary embodiment, the invention is not limited to this, and an embodiment to correct the amount of ink droplets discharged from the nozzle 60 by correcting the volume of the driving voltage β shown in FIG. 10 and an embodiment to correct the amount of ink droplets discharged from the nozzle 60 by correcting a time to apply the driving voltage α or the driving voltage β. In this case also, the similar effect as that of the exemplary embodiment may be obtained.

Also, although a case in which the correction amount is determined in advance separate from the image forming process and the amount of ink droplets discharged from the correction nozzle 60γ is corrected based on the correction amount determined in advance each time to execute the image forming process is described in the exemplary embodiment, the invention is not limited to this, and an embodiment to determine a new correction amount each time to execute the image forming process is possible. In this case also, the similar effect as in the exemplary embodiment may be obtained.

Also, although the correction amount of the adjacent nozzles is determined based on the read image data of the test pattern generated by reading the test pattern formed on the recording paper 14 by the image readout unit 44 in the exemplary embodiment, the invention is not limited to this, and an embodiment to determine the correction amount of the ink droplets discharged from the correction nozzle 60γ by visually confirming the test pattern formed on the recording paper 14 by the user, and inputting the correction amount of correction nozzle 60γ for the recording head 50 to the inkjet recording device 10 through an operation panel provided on the ink-jet recording device 10 or the host device 89 is possible.

Figure 14:
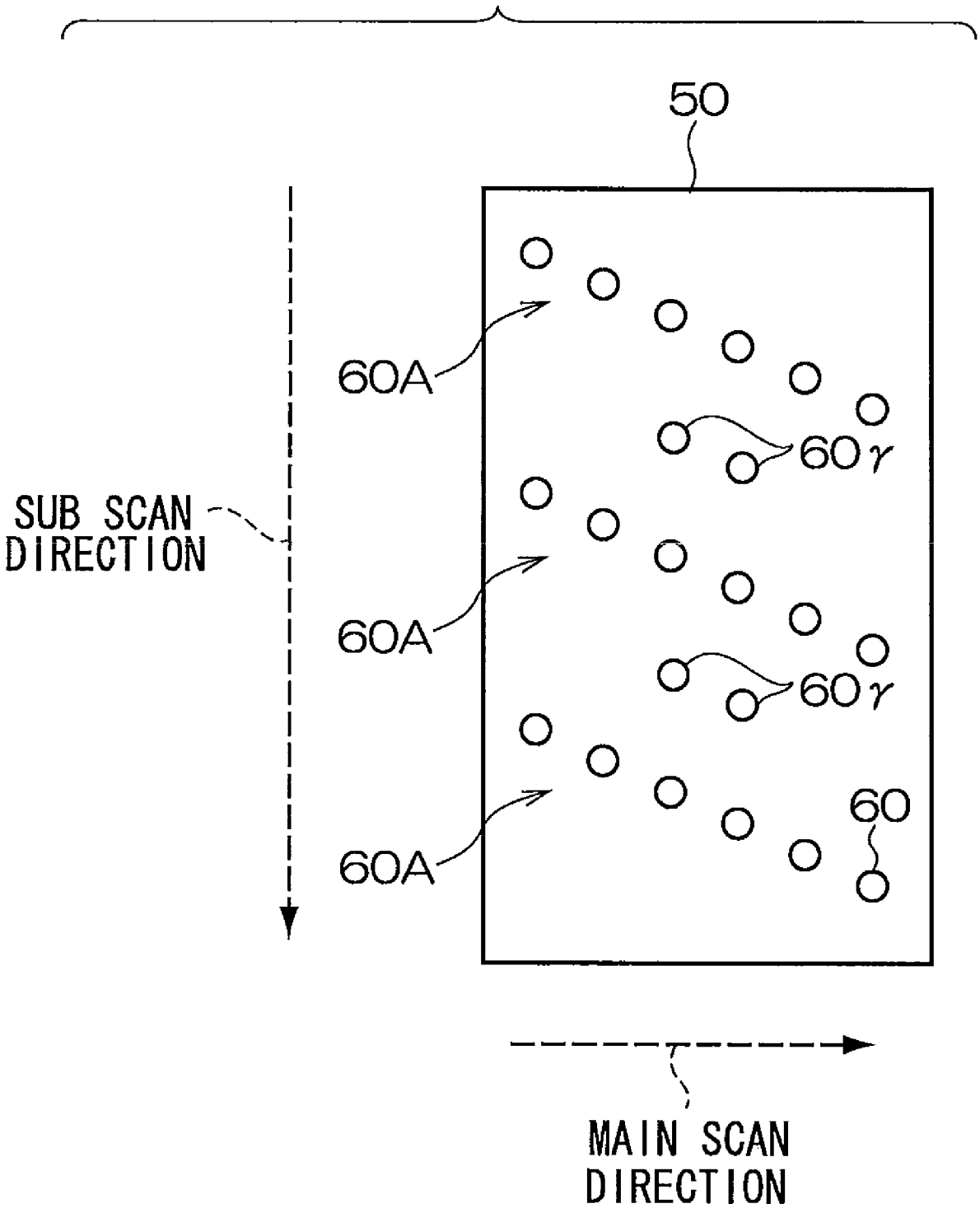
FIG. 14 is a view showing an arrangement position of a nozzle of the recording head according to another exemplary embodiment.

Although one correction nozzle 60γ is provided on the recording head 50 in the exemplary embodiment, the invention is not limited to this, and an embodiment to provide plural correction nozzles 60γ on the recording head 50 as shown in FIG. 14 is possible as one example.

Figure 15:
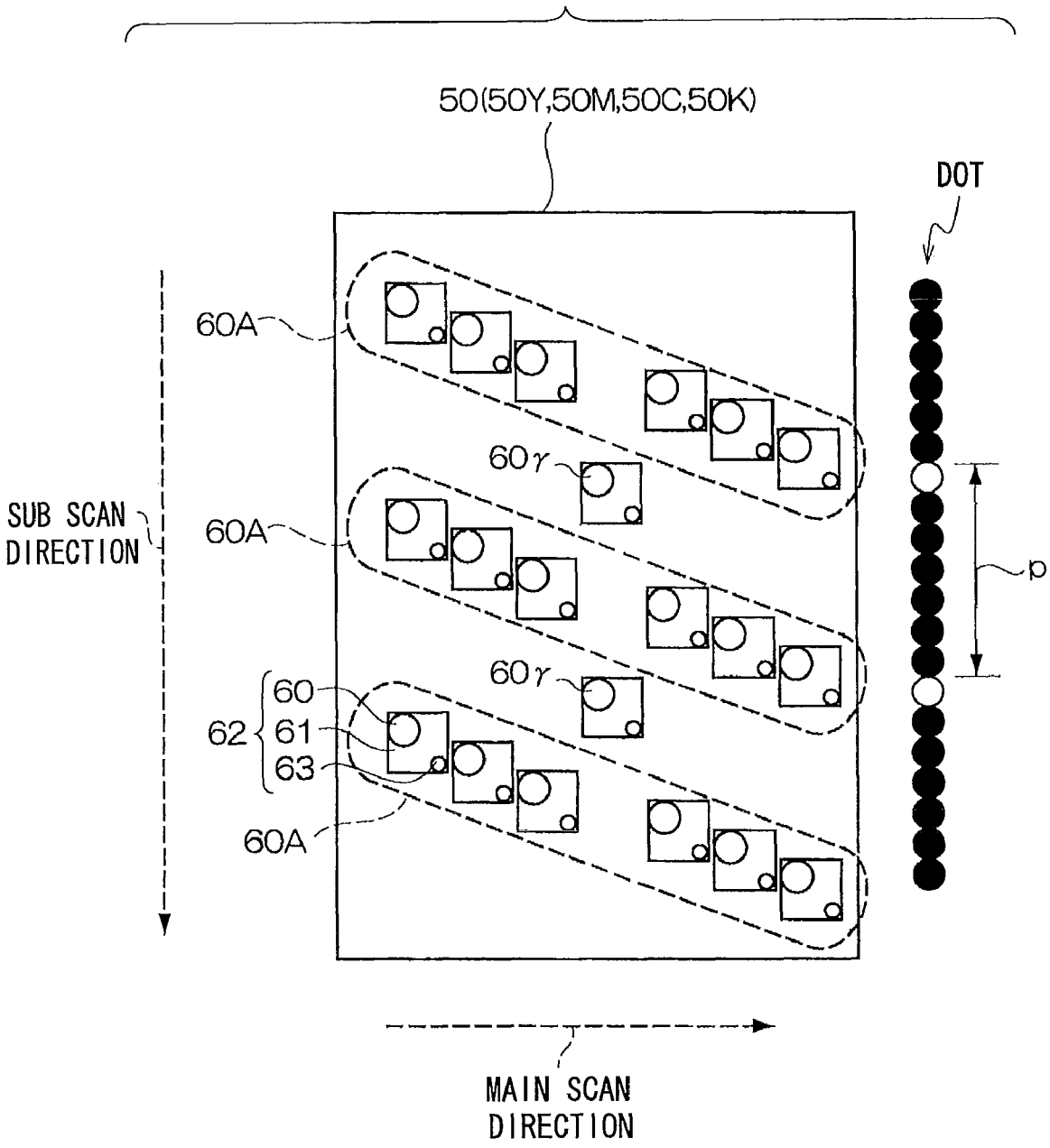
FIG. 15 is a view showing an arrangement position of a nozzle of the recording head according to another exemplary embodiment.
Figure 16:
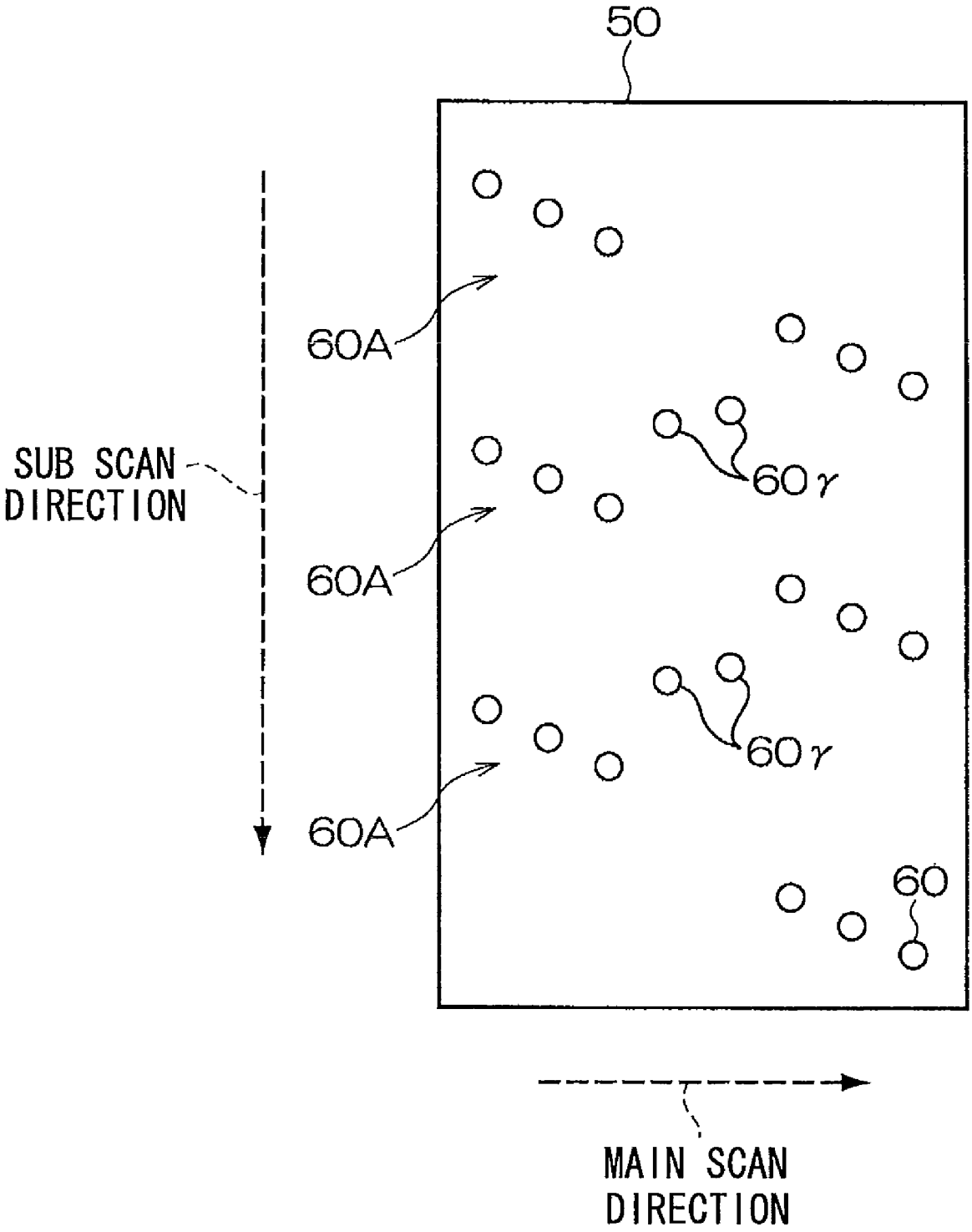
FIG. 16 a view showing an arrangement position of a nozzle of the recording head according to another exemplary embodiment.
Figure 17:
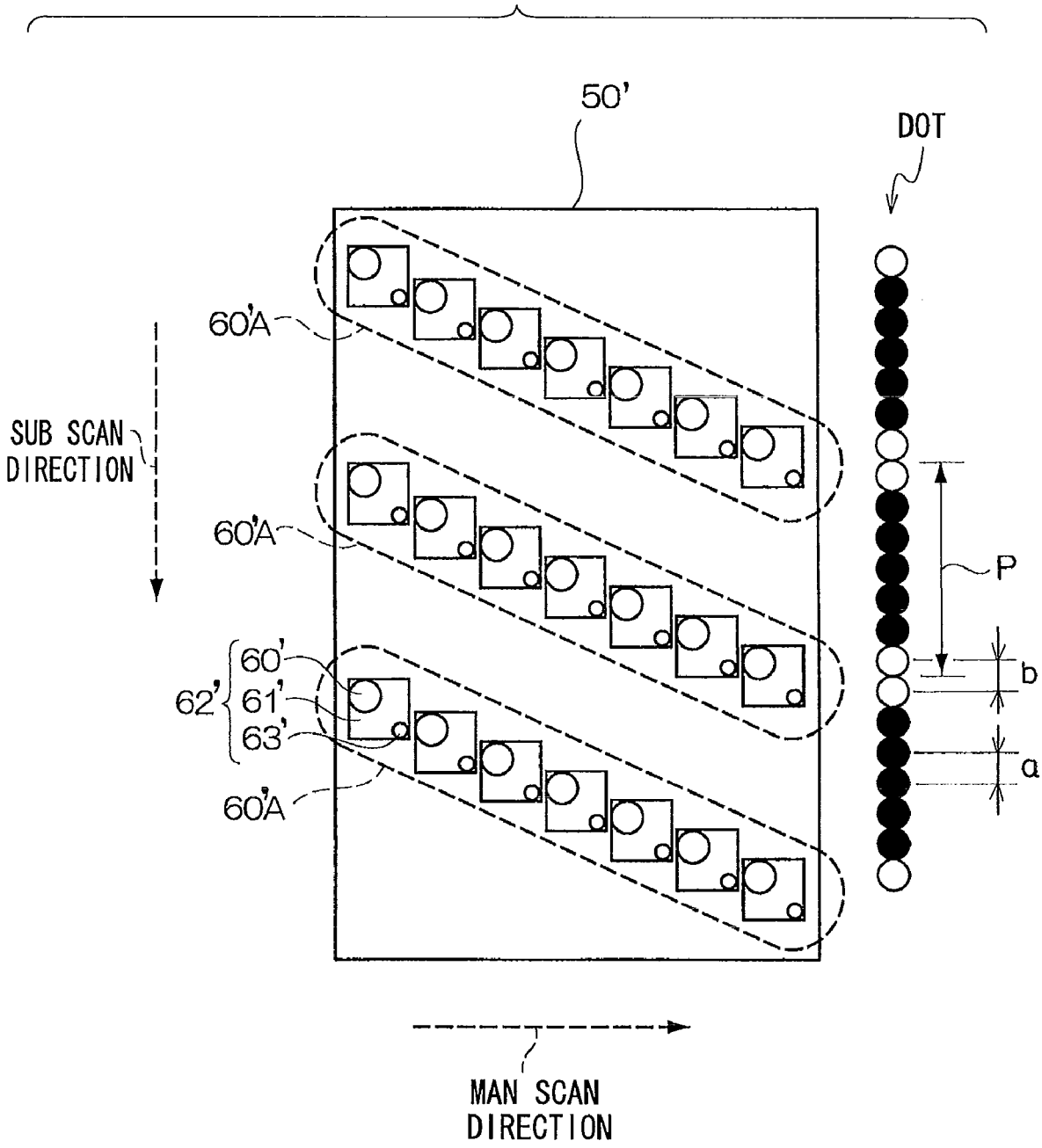
FIG. 17 is a view showing an arrangement position of a nozzle of a conventional recording head.

An embodiment to make a positional relationship between the nozzle group 60A and the correction nozzle 60γ as the positional relationship shown in FIG. 15, by arranging the nozzle 60' on the central portion of the respective nozzle groups 60A' shown in FIG. 17 on a substantially central portion in the main scan direction between the adjacent nozzles 60' between the nozzle groups 60A' adjacent in the sub scan direction so as not to be overlapped with other nozzles 60' in the main scan direction. Also, an embodiment in which plural correction nozzles 60γ are provided as shown in FIG. 16, by arranging one of two nozzles 60' located on the central portion of the respective nozzle groups 60A' so as to be displaced on the upstream side in the sub scan direction and the other so as to be displaced on the downstream side in the sub scan direction.

Furthermore, as the ink-jet recording device 10, instead of correcting the amount of the droplets from the correction nozzle 60γ, the amount of the droplets from the adjacent nozzles 60α and 60β may be corrected. In this case, the correction nozzle 60γ may be omitted.

In the above-mentioned example where the amount of the droplets from the adjacent nozzles 60α and 60β may be corrected, a droplet discharge device includes a recording head that comprises a plurality of nozzle groups. Each of the nozzle groups include plural nozzles that respectively form dots, which make up an image, on a recording medium by discharging droplets and being arranged in a straight line inclined with respect to a main scan direction at a predetermined angle. The plural nozzle groups is arranged in a sub scan direction such that intervals in the sub scan direction between nozzles adjacent in the sub scan direction are substantially identical and positions in the sub scan direction of nozzles belonging to the respective nozzle groups are substantially aligned. The droplet discharge device further includes a moving unit that moves the recording head back and forth in the main scan direction, a conveyance unit that relatively conveys at least one of the recording head and the recording medium in the sub scan direction, a determination unit that determines a correction amount of droplets discharged from at least one of adjacent nozzles of nozzle groups adjacent in the sub scan direction, and a control unit that controls droplet discharge by the recording head while correcting the amount of the droplets discharged from the at least one of the adjacent nozzles of the nozzle groups adjacent in the sub scan direction, based on the correction amount determined by the determination unit when forming the image on the recording medium. Therefore, concentration unevenness in the sub scan direction of the formed image, which is occurred due to the head posture inclination when the matrix type recording head moves in the main scan direction, may be reduced without having the complicated configuration.

Further, in the above-mentioned example, the determination unit determines the correction amount in accordance with each of a case in which the moving unit moves the recording head forward in the main scan direction and a case in which the moving unit moves the recording head backward in the main scan direction. Therefore, the occurrence of the concentration unevenness in the sub scan direction of the image to be formed may be further reduced.

Furthermore, in the above-mentioned example, the droplet discharge device further includes a reading unit that reads a concentration distribution in the sub scan direction of a test pattern comprising a plurality of images formed by the recording head when the amounts of respective droplets discharged from the at least one of the adjacent nozzles of the nozzle groups adjacent in the sub scan direction differ, and the amounts of droplets discharged from other nozzles are identical. The determination unit determines the correction amount based on a result of concentration distribution in the sub scan direction of the test pattern that is read by the reading unit. Therefore, more appropriate correction amount when forming the image may be determined.

Second Exemplary Embodiment

Hereinafter, a second exemplary embodiment of the present invention is described in detail with reference to the drawings. Meanwhile, herein, a case in which the invention is applied to an ink-jet recording device is described.

Figure 18:
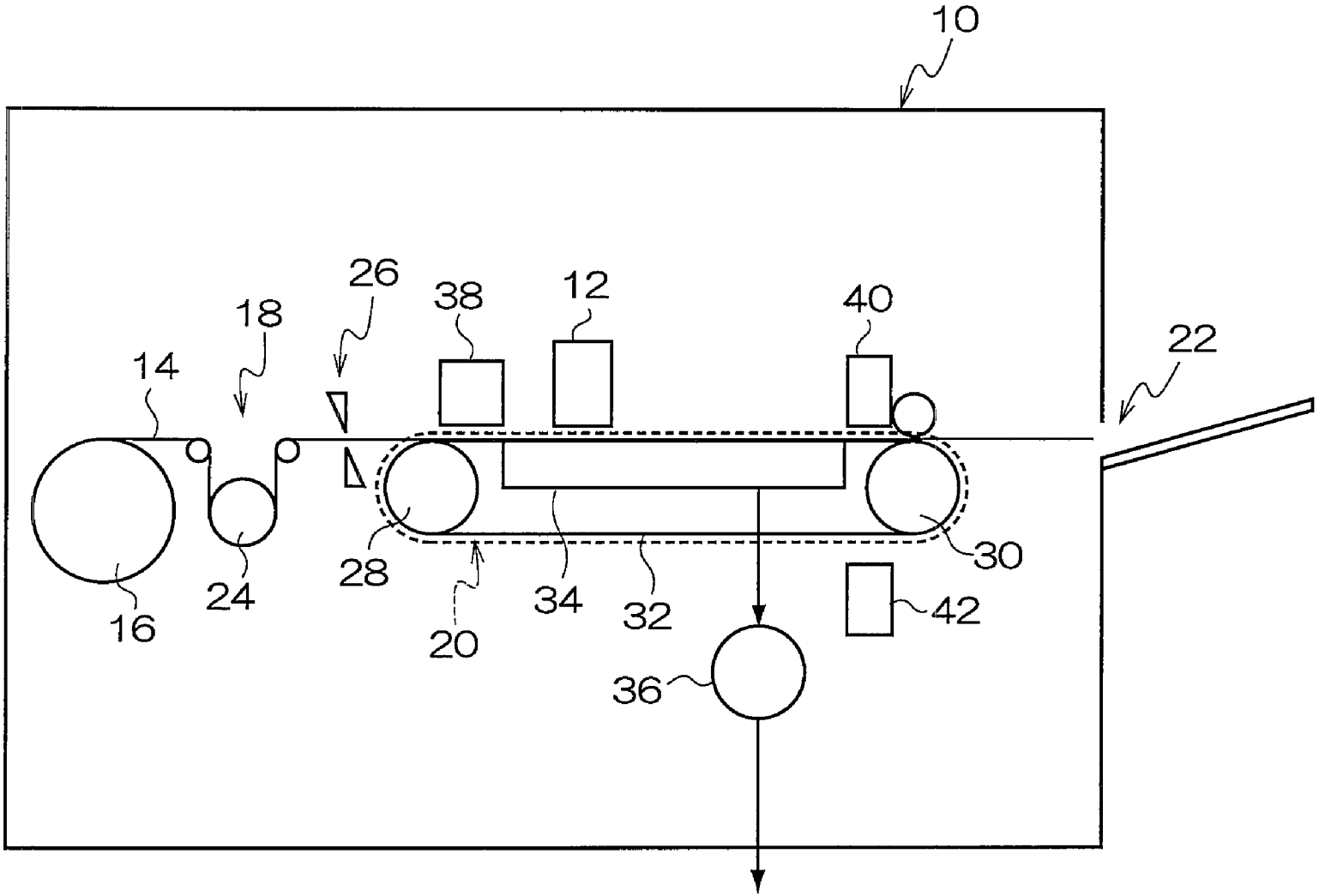
FIG. 18 is a broken side view showing a configuration of an inkjet recording device according to a second exemplary embodiment.
Figure 19:
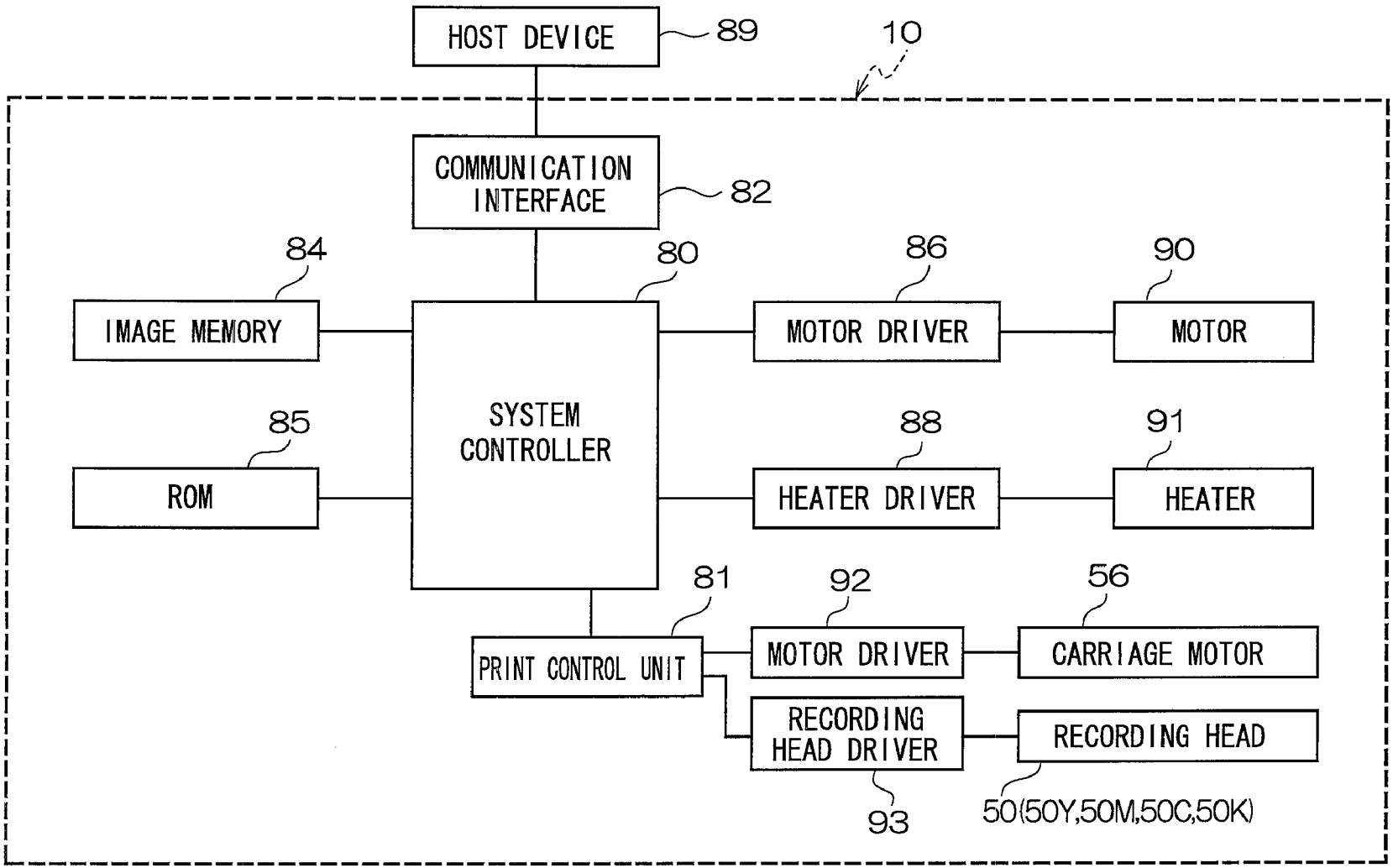
FIG. 19 is a block diagram showing a substantial configuration of an electrical system of the ink-jet recording device according to the second exemplary embodiment.

FIG. 18 and FIG. 19 show respectively an entire configuration and an electric configuration of an ink-jet recording device 10 according to this exemplary embodiment. Elements of the device 10 are similar to of the respective elements described in the first exemplary embodiment except that the image reading unit 44 in FIG. 1 and FIG. 6 is not provided. Therefore, the entire configuration is not repeatedly described in this embodiment.

Meanwhile, the ink-jet recording device 10 according to this exemplary embodiment is provided with a belt connecting unit 53 on one end portion of a carriage 51 (right end portion on FIG. 2 of an end surface of a side into which the guide rail 52 is inserted, in this exemplary embodiment). Thereby, it becomes possible to easily move the carriage 51 back and forth in the main scan direction while inclining the same in directions opposed to each other with respect to an axis orthogonal to the main scan direction in the forward movement and in the backward movement.

In the recording head 50 provided on the ink-jet recording device 10 according to this exemplary embodiment, plural (three, in this exemplary embodiment) nozzle groups 60A in which plural (seven, in this exemplary embodiment) nozzles 60 are arranged on a straight line inclined with respect to the main scan direction at a predetermined angle are arranged in a sub scan direction such that intervals in the sub scan direction between the nozzles 60 adjacent in the sub scan direction are substantially identical and positions in the sub scan direction of the nozzles 60 belonging to the respective nozzle groups 60A are substantially identical. Thereby, high-density substantial nozzle interval projected so as to be arranged along the sub scan direction (hereinafter, referred to as a "projected nozzle pitch") is realized, and the high-density dot pitch is obtained. Meanwhile, hereinafter, a width in the sub scan direction of a dot forming area by one nozzle group 60A is referred to as a folded pitch P.

Hereinafter, a density distribution in the sub-scan direction of the dots formed by the ink-jet recording device 10 according to this exemplary embodiment is described with reference to FIGS. 7A and 7B in the first embodiment.

The ink-jet recording device 10 moves the carriage 51 back and forth in the main scan direction while inclining the same in directions opposed to each other with respect to the axis orthogonal to the main scan direction in the forward movement and in the backward movement when forming an image.

Therefore, as shown in FIG. 7A, the recording head 50 provided on the carriage 51 moves while being inclined at an angle $\theta_1$, such that an upstream side portion thereof in the sub scan direction gets behind a downstream side portion thereof in the sub scan direction when this moves forward in the main scan direction.

Therefore, a projected nozzle pitch in the sub scan direction of adjacent nozzles 60α and 60β between the nozzle groups 60A adjacent in the sub scan direction (hereinafter, referred to as "adjacent nozzles") out of a plurality of nozzles 60 composing the nozzle group 60A (hereinafter, referred to as "projected adjacent nozzle pitch") becomes shorter than that in a case in which the recording head 50 is not inclined, and on the other hand, a projected nozzle pitch (hereinafter, referred to as "projected intermediate portion nozzle pitch") in the sub scan direction of the nozzles other than the adjacent nozzles 60α and 60β (hereinafter, referred to as "intermediate portion nozzles") becomes longer than in a case in which the recording head 50 is not inclined. Thereby, the density in the sub scan direction of the dots formed by the adjacent nozzles 60α and 60β becomes thick, and on the other hand, the density in the sub scan direction of the dots formed by the intermediate portion nozzles becomes thin.

On the other hand, as shown in FIG. 7B, the recording head 50 provided on the carriage 51 moves while being inclined at an angle $\theta_2$, such that the downstream side portion thereof in the sub scan direction gets behind the upstream side portion thereof in the sub scan direction when this moves backward in the main scan direction.

Therefore, the projected adjacent nozzle pitch becomes longer than in a case in which the recording head 50 is not inclined, and on the other hand, the projected intermediate portion nozzle pitch becomes shorter than in a case in which the recording head 50 is not inclined. Thereby, the density in the sub scan direction of the dots formed by the adjacent nozzles 60α and 60β becomes thin, and on the other hand, the density in the sub scan direction of the dots formed by the intermediate portion nozzles becomes thick.

In this manner, the carriage 51 is moved back and forth in the main scan direction while being inclined in directions opposed to each other with respect to the axis orthogonal to the main scan direction in the forward movement and in the backward movement, so that the density in the sub scan direction of the dots formed by the recording head 50 is different in the forward movement and in the backward movement.

Further, in the ink-jet recording device 10 according to this exemplary embodiment, allowance of the insertion hole into which the guide rail 52 of the carriage 51 is inserted and a motion speed of the carriage belt 54 are adjusted such that the carriage 51 may be moved back and forth in the main scan direction in a state in which the angles $\theta_1$ and $\theta_2$ are substantially symmetric with respect to the axis orthogonal to the main scan direction in the forward movement and in the backward movement.

Then, the ink-jet recording device 10 according to this exemplary embodiment equalizes the density distribution of the dots in the sub scan direction on the recording paper 14 by overlapping the dots formed by the forward movement and the dots formed by the backward movement by adjusting the distance to convey the recording paper 14 in the sub scan direction between the forward movement and the backward movement of the carriage 51.

Figure 20:
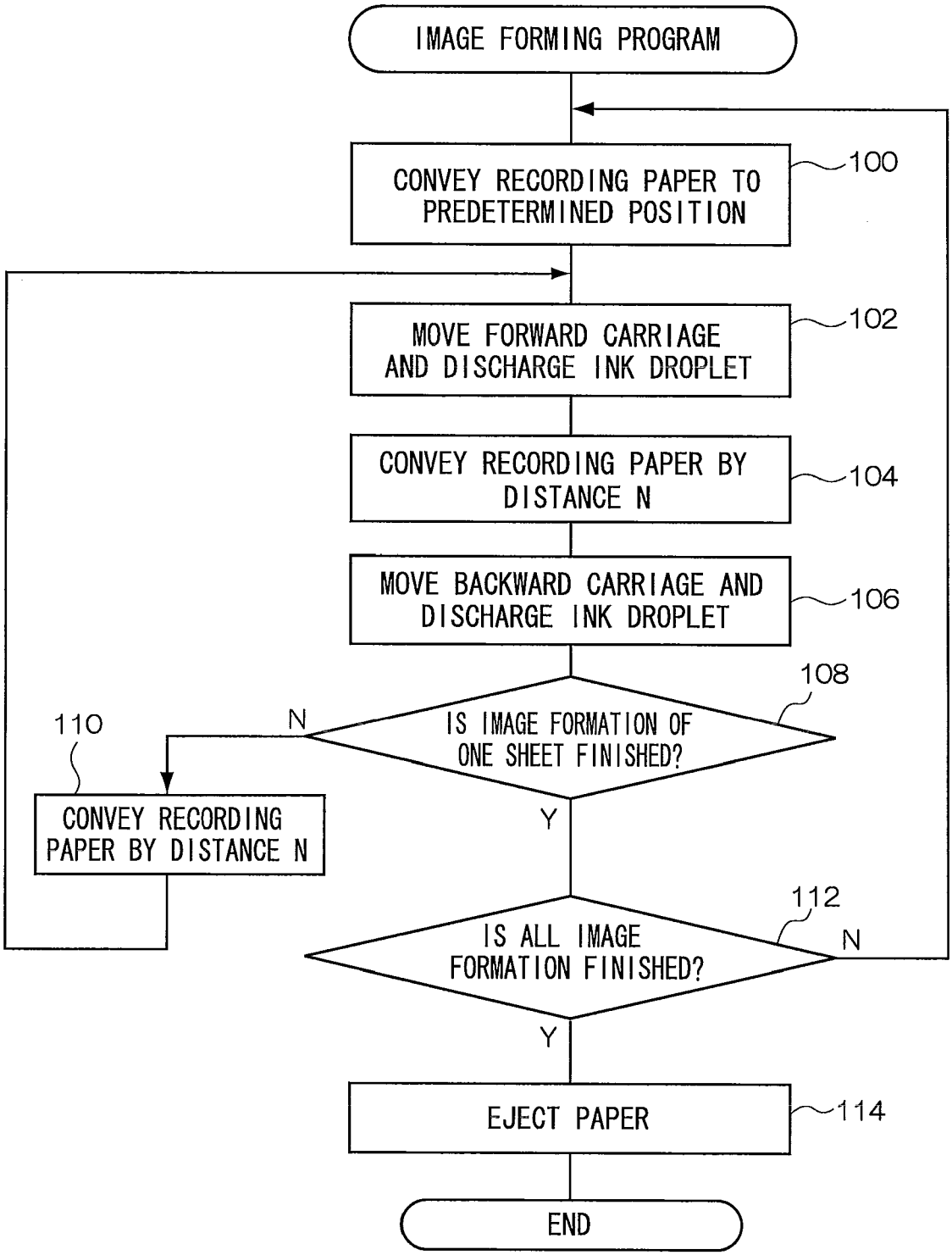
FIG. 20 is a flowchart showing a process flow according to the second exemplary embodiment.

Next, an operation of the ink-jet recording device 10 according to this exemplary embodiment is described with reference to FIG. 20. Meanwhile, this figure is a flowchart showing a process flow of the image forming program executed by the CPU of the system controller 80 when forming the image indicated by the image data, and the program is stored in advance in the storage area of the ROM 85.

First, at a step 100 in this figure, the motor driver 86 is controlled to convey the recording paper 14 to a position at which the carriage 51 is arranged. Thereby, the motor driver 86 conveys the recording paper 14 to the position at which the carriage 51 is arranged by means of a belt conveying unit 20 by driving the motor 90. Meanwhile, the curl of the recording paper 14 is removed by the decurling unit 18 and the recording paper 14 is cut into a desired size with the cutter 26 in the course of the above-described conveyance.

At a next step 102, the print controlling unit 81 is controlled to allow the recording head 50 to discharge the ink droplet by using the ink discharge data while allowing the carriage 51 to move forward in the main scan direction. Thereby, the print controlling unit 81 allows the nozzle 60 of the recording head 50 to discharge the ink droplet based on the ink discharge data while allowing the carriage 51 to move forward in the main scan direction by positively rotating the rotational axis of the carriage motor 56 through the motor driver 92.

At a next step 104, the motor driver 86 is controlled to convey the recording paper 14 in the sub scan direction.

Meanwhile, in the ink-jet recording device 10 according to this exemplary embodiment, a predetermined integer smaller than the number of the nozzle groups 60A, which one recording head 50 has, is set to m (two, in this exemplary embodiment) and the folded pitch is set to P as described above, and the recording paper 14 is conveyed in the sub scan direction by a distance N calculated by a following equation (1).

$$N=m\times P \quad (1)$$

The ink-jet recording device 10 according to this exemplary embodiment calculates the distance N in advance and stores the same in the image memory 84 in advance.

The motor driver 86 conveys the recording paper 14 by the distance N by means of the belt conveying unit 20 by rotate-driving the motor 90 by the rotational number according to the distance N.

At a next step 106, the print controlling unit 81 is controlled to allow the recording head 50 to discharge the ink droplet by using the ink discharge data while allowing the carriage 51 to move backward in the main scan direction. Thereby, the print controlling unit 81 allows the nozzle 60 of the recording head 50 to discharge the ink droplet based on the ink discharge data while allowing the carriage 51 to move backward in the main scan direction by negatively rotating the rotational axis of the carriage motor 56 through the motor driver 92.

Meanwhile, in the process at the step 104, by conveying the recording paper 14 in the sub scan direction by the distance N, the dots formed while moving the carriage 51 backward and the dots formed while moving the carriage 51 forward are overlapped every folded pitch P, so that the density distribution in the sub scan direction of the dots formed on the recording paper 14 is equalized.

At a next step 108, it is judged whether the formation of the image indicated by the image data corresponding to one sheet of the recording paper 14 is finished, and when the formation is judged to be not finished, the procedure shifts to a step 110 to control the motor driver 86 to convey the recording paper 14 in the sub scan direction by the distance N and returns back to the above-described step 102, and when this is judged to be finished, the procedure shifts to a step 112.

At the step 112, it is judged whether the formation of the image indicated by entire image data stored in the image memory 84 is finished, and when the formation is judged to be not finished, the procedure returns back to the step 100 to execute the formation of the image indicated by remaining image data, and on the other hand, when this is judged to be finished, the procedure shifts to a step 114.

At the step 114, the motor driver 86 is controlled to eject the recording paper 14 on which the image is formed. Thereby, the motor driver 86 conveys the recording paper 14 to the paper ejecting unit 22 by means of the belt conveying unit 20 by driving the motor 90.

As is described in detail above, in this exemplary embodiment, a droplet discharge device includes, a recording head, a moving unit and a conveyance unit. The recording head includes plural nozzle groups, each of the nozzle groups includes plural nozzles that respectively form dots, which make up an image, on a recording medium by discharging droplets and being arranged in a straight line inclined with respect to a main scan direction at a predetermined angle. The plural nozzle groups are arranged in a sub scan direction such that intervals in the sub scan direction between nozzles adjacent in the sub scan direction are substantially identical and positions in the sub scan direction of nozzles belonging to the respective nozzle groups are substantially identical. The moving unit moves the recording head back and forth in the main scan direction while inclining the recording head in one direction with respect to an axis orthogonal to the main scan direction during forward movement and in an opposing direction with respect to the axis orthogonal to the main scan direction during the backward movement. The conveyance unit relatively conveys at least one of the recording head and the recording medium in the sub scan direction during the forward movement and the backward movement of the recording head by the moving unit, by a distance obtained by multiplying a predetermined integer smaller than the number of the nozzle groups by a width in the sub scan direction of a dot forming area of one of the nozzle groups.

Also, the moving unit moves the recording head back and forth in the main scan direction while inclining the recording head in the one direction and the opposing direction by applying a force to one end portion of the recording head in a direction in which the recording head is to be moved.

The moving unit moves the recording head back and forth in the main scan direction such that respective angles of inclination with respect to the axis orthogonal to the main scan direction during the forward movement and during the backward movement of the recording head are substantially symmetrical with respect to the axis.

Figure 21:
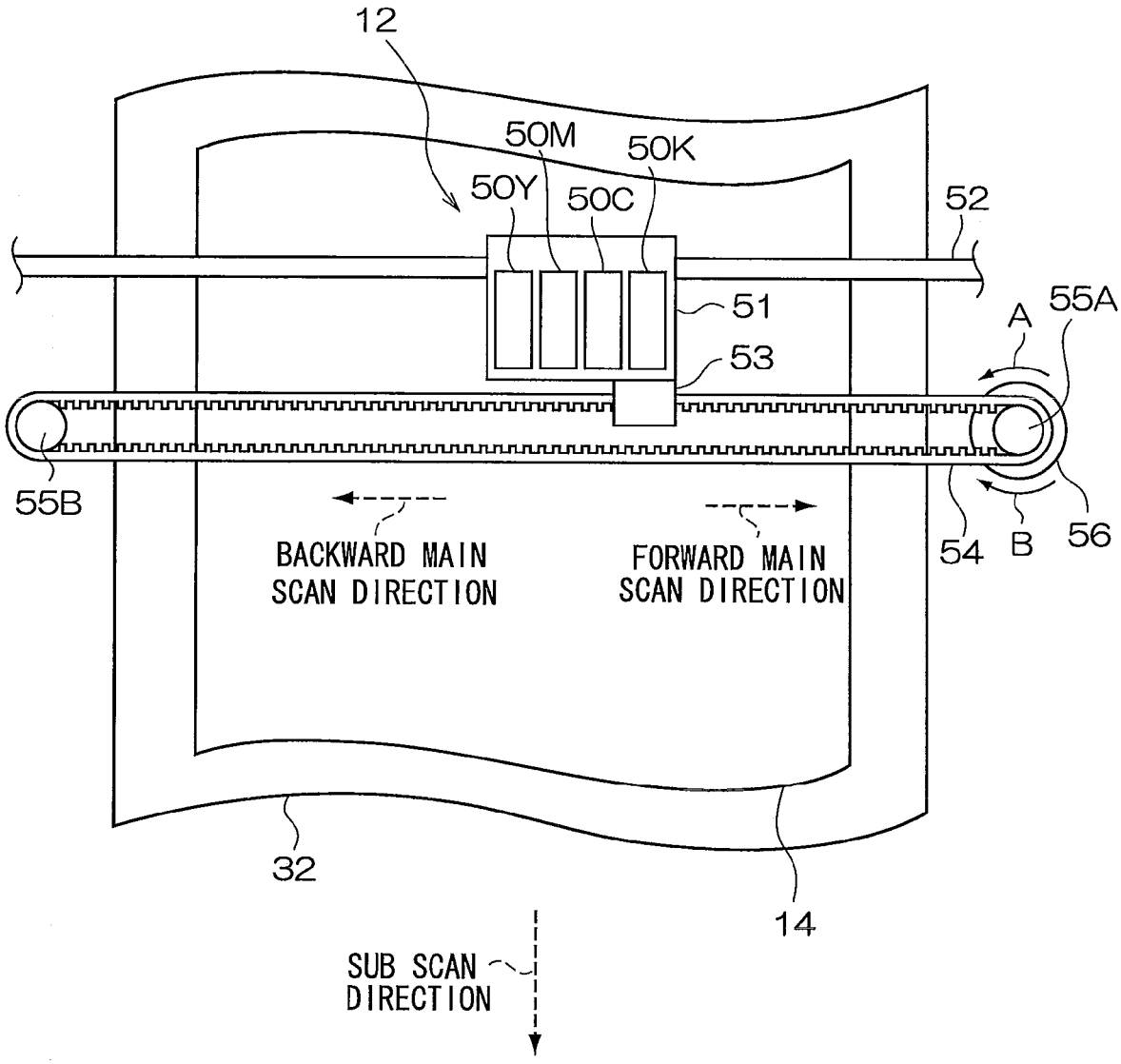
FIG. 21 is a view showing another configuration according to the second exemplary embodiment.

Although the case in which the belt connecting unit 53 is provided on the right end portion of the end surface of the side into which the guide rail 52 of the carriage 51 is inserted has been described in the above-described exemplary embodiment, the invention is not limited to this, and the belt connecting unit 53 may be provided on a left end portion or a central portion of the above-described surface, or on a left end portion, a right end portion, or a central portion on FIG. 21 of an end surface of a side into which the guide rail 52 of the carriage 51 is not inserted as shown in FIG. 21. In this case also, the effect similar to that of the above-described exemplary embodiment may be obtained.

As is described in detail above, in this exemplary embodiment, a droplet discharge device including a recording head, a moving unit, and a conveyance unit. The recording head includes plural nozzle groups, each of the nozzle groups including plural nozzles that respectively form dots, which make up an image, on a recording medium by discharging droplets and being arranged in a straight line inclined with respect to a main scan direction at a predetermined angle. The plural nozzle groups are arranged in a sub scan direction such that intervals in the sub scan direction between nozzles adjacent in the sub scan direction are substantially identical and positions in the sub scan direction of nozzles belonging to the respective nozzle groups are substantially identical. The moving unit moves the recording head back and forth in the main scan direction while inclining the recording head in one direction with respect to an axis orthogonal to the main scan direction during forward movement and in an opposing direction with respect to the axis orthogonal to the main scan direction during the backward movement. The conveyance unit relatively conveys at least one of the recording head and the recording medium in the sub scan direction during the forward movement and the backward movement of the recording head by the moving unit, by a distance obtained by multiplying a predetermined integer smaller than the number of the nozzle groups by a width in the sub scan direction of a dot forming area of one of the nozzle groups. Therefore, concentration unevenness in the sub scan direction of the formed image, which is occurred due to the head posture inclination when the matrix type recording head moves in the main scan direction, may be reduced without having the complicated configuration.

Additionally, the moving unit moves the recording head back and forth in the main scan direction while inclining the recording head in the one direction and the opposing direction by applying a force to one end portion of the recording head in a direction in which the recording head is to be moved. Therefore, when the recording head moves back and forth, the inclination of the recording head in the one direction and the opposing direction may be secured by a simpler manner.

Furthermore, the moving unit moves the recording head back and forth in the main scan direction such that respective angles of inclination with respect to the axis orthogonal to the main scan direction during the forward movement and during the backward movement of the recording head are substantially symmetrical with respect to the axis. Therefore, the density distribution of the dots in dots formed area may be substantially opposite when the recording head moves back and forth, and reduction of occurrence of the concentration unevenness of the folded pitch P for the nozzle line may be secured.

Other Exemplary Embodiments

As described above, the invention is described along with the exemplary embodiments, the technical scope of the invention is not limited to the scope of the exemplary embodiments. Various changes and modifications may be made to the embodiments without departing from the spirit of the invention, and the embodiments with the changes and modifications also are included in the technical scope of the invention.

Also, the exemplary embodiments are not to limit the invention according to claims, and not all the combinations of features described in the exemplary embodiments are indispensable to solve the problem of the invention. The exemplary embodiments include the invention in various stages, and various inventions may be extracted by combination of plural components disclosed. Even when some of the components are deleted from all the components described in the exemplary embodiments, the configuration obtained by deleting some components may be extracted as the invention as long as there is an effect.

For example, although when the ink liquid discharged by the recording head 50 are of four colors, Y, M, C, and K, has been described in the exemplary embodiments, the invention is not limited to this, and the combination of the colors and the number of colors may be changed, and special color ink liquid such as pale color ink liquid, deep color ink liquid, and light ink liquid such as light cyan liquid and light magenta liquid may be added. In this case also, the similar effect as that of the exemplary embodiments may be obtained.

In addition, although when the ink droplets are discharged by using the piezoelectric element has been described as the method to discharge the ink droplets from the recording head 50 in the exemplary embodiments, the invention is not limited to this, and may use another method such as a thermal jet method to generate air bubble by heating the ink liquid by a heat generator such as a heater to splash the ink droplets by the pressure thereof. In this case also, the effect similar to that in the exemplary embodiments may be obtained.

Although a case of relatively moving the carriage 51 and the recording paper 14 by moving only the recording paper in the sub scan direction has been described in the exemplary embodiments, the invention is not limited to this, and an embodiment in which the recording paper 14 is fixed and the carriage 51 is moved in the sub scan direction to relatively move the carriage 51 and the recording paper 14, and an embodiment in which the carriage 51 along with the recording paper 14 is moved in the sub scan direction. In this case also, the similar effect as that of the exemplary embodiments may be obtained.

Although a case in which the recording head 50 is provided with plural nozzle groups 60A with plural nozzles 60 arranged on a straight line inclined from the downstream side to the upstream side in the sub scan direction has been described in the exemplary embodiments, the invention is not limited to this, and an embodiment in which the recording head 50 is provided with plural nozzle groups 60A with plural nozzles 60 arranged on a straight line inclined from the upstream side to the downstream side in the sub scan direction is possible. In this case also, the similar effect as that of the embodiments may be obtained.

Although a case in which one guide rail 52 is inserted into the carriage 51 has been described in the exemplary embodiments, the invention is not limited to this, and an embodiment in which two guide rails 52 are inserted into the carriage 51 is possible.

In addition, it goes without saying that the configuration of the ink-jet recording device 10 described in the exemplary embodiments is one example, and unnecessary portion may be deleted and a new portion may be added without departing from the spirit of the invention.

Also, it goes without saying that the process flow of the image forming program described in the exemplary embodiments is one example, and unnecessary step may be deleted and new step may be added, and the process order may be changed without departing from the spirit of the invention.

The invention claimed is:

1. A recording head comprising:

a plurality of nozzle groups, each of the nozzle groups comprising a plurality of nozzles that respectively form dots, which make up an image, on a recording medium by discharging droplets, the nozzles being arranged in a straight line that is inclined with respect to a main scan direction at a predetermined angle, the plurality of nozzle groups being arranged in a sub scan direction such that intervals in the sub scan direction between nozzles adjacent in the sub scan direction are substantially identical and positions in the sub scan direction of nozzles belonging to the respective nozzle groups are substantially aligned; and a second nozzle that is disposed at a substantially central portion in the main scan direction between adjacent nozzles of nozzle groups adjacent in the sub scan direction so as not to overlap with any other nozzle in the main scan direction.

2. The recording head according to claim 1, wherein the second nozzle is disposed at a position at which intervals in the sub scan direction between the second nozzle and nozzles, which are adjacent to the second nozzle upstream and downstream of the sub scan direction, are substantially equal to intervals between nozzles in the sub scan direction that belong to the respective nozzle groups.

3. A droplet discharge device, comprising:

the recording head according to claim 1;

a moving unit that moves the recording head back and forth in the main scan direction;

a conveyance unit that relatively conveys at least one of the recording head and the recording medium in the sub scan direction;

a determination unit that determines a correction amount of droplets discharged from the second nozzle; and a control unit that controls droplet discharge by the recording head while correcting the amount of the droplets discharged from the second nozzle based on the correction amount determined by the determination unit, when forming an image on the recording medium.

4. The droplet discharge device according to claim 3, wherein the determination unit determines the correction amount in accordance with each of a case in which the moving unit moves the recording head forward in the main scan direction and a case in which the moving unit moves the recording head backward in the main scan direction.

5. The droplet discharge device according to claim 3, wherein:

the determination unit further determines a correction amount of droplets discharged from a predetermined number of nozzles in ascending order of distance from the second nozzle on a downstream side and on an upstream side in the sub scan direction; and the control unit controls the droplet discharge by the recording head while correcting the amount of the droplets discharged from the second nozzle and the predetermined number of nozzles based on the correction amount determined by the determination unit, when forming the image on the recording medium.

6. The droplet discharge device according to claim 3, further comprising a reading unit that reads a concentration distribution in the sub scan direction of a test pattern comprising a plurality of images formed by the recording head when the amounts of respective droplets discharged from the second nozzle differ and the amounts of droplets discharged from other nozzles are identical, wherein the determination unit determines the correction amount based on a result of concentration distribution in the sub scan direction of the test pattern that is read by the reading unit.

7. The droplet discharge device according to claim 6, wherein the plurality of images are separate images for respective colors, the reading unit reads the plurality of images of the respective colors, and the determination unit determines the correction amount for each of the respective colors based on the result read by the reading unit.

8. The droplet discharge device according to claim 6, wherein the plurality of images are separate images for respective areas of different concentration, the reading unit reads the plurality of images of the respective areas of different concentration, and the determination unit determines the correction amount for each of the respective concentration areas based on the result read by the reading unit.

9. A droplet discharge method in a droplet discharge device that comprises the recording head according to claim 1, a moving unit that moves the recording head back and forth in the main scan direction, and a conveyance unit that relatively conveys at least one of the recording head and the recording medium in the sub scan direction, the method comprising:

determining a correction amount of a droplet discharged from the second nozzle so as to reduce concentration unevenness in the sub scan direction of the image formed on the recording medium; and controlling droplet discharge by the recording head while correcting the amount of the droplets discharged from the second nozzle based on the correction amount, when forming the image on the recording medium.

* * * * *